US007622432B2

(12) United States Patent
Negoro et al.

(10) Patent No.: US 7,622,432 B2
(45) Date of Patent: Nov. 24, 2009

(54) LUBRICANT COMPOSITION AND TRIAZINE-RING-CONTAINING COMPOUND

(75) Inventors: Masayuki Negoro, Minami-ashigara (JP); Ken Kawata, Minami-ashigara (JP)

(73) Assignee: Fujifilm Corporation, Minato-Ku, Tokyo (JP)

( * ) Notice: Subject to any disclaimer, the term of this patent is extended or adjusted under 35 U.S.C. 154(b) by 505 days.

(21) Appl. No.: 10/822,782

(22) Filed: Apr. 13, 2004

(65) Prior Publication Data

US 2004/0266633 A1 Dec. 30, 2004

(30) Foreign Application Priority Data

Apr. 14, 2003 (JP) ..... 2003-109037

(51) Int. Cl.
*C07D 251/54* (2006.01)
*C10M 133/42* (2006.01)

(52) U.S. Cl. ..... 508/257; 508/258; 544/180

(58) Field of Classification Search ..... 508/258, 508/257; 544/180

See application file for complete search history.

(56) References Cited

U.S. PATENT DOCUMENTS 4,006,274 A * 2/1977 Chance et al. ..... 427/381
5,498,809 A * 3/1996 Emert et al. ..... 585/13
2003/0124158 A1* 7/2003 Heidenfelder et al. ..... 424/401

FOREIGN PATENT DOCUMENTS

EP 1055421 A2 * 11/2000
JP 2002069472 A * 3/2002

* cited by examiner

*Primary Examiner*—Glenn Caldarola
*Assistant Examiner*—Jim Goloboy
(74) *Attorney, Agent, or Firm*—Buchanan Ingersoll & Rooney PC

(57) ABSTRACT

A novel lubricant composition is disclosed. The composition comprises the compound selected from the formula (1), where D represents an m-valent cyclic group capable of bonding to "m" of —X—R; Xs respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; Rs respectively represent a substituted or non-substituted alkyl, alkenyl, alkynyl, aryl or heterocyclic group provided that at least one R contains an ester bond; and m is an integer from 2 to 11. And a novel compound represented by the formula (2), where $X^1$ to $X^3$ respectively represent a single bond or abivalent linking group selected from the group consisting of $NR^1$, oxygen, sulfur, carbonyl, sulfonyl and any combinations thereof; and $R^{11}$ to $R^{13}$ respectively represent a substituted or non-substituted alkyl, alkenyl, alkynyl, aryl or heterocyclic group provided that at least one of them contains an ester bond; is also disclosed Formula (1)

Formula (2)

5 Claims, No Drawings

LUBRICANT COMPOSITION AND TRIAZINE-RING-CONTAINING COMPOUND

FIELD OF THE INVENTION

The present invention belongs to technical fields of lubricant compositions to be supplied to mechanical friction sliding members and of triazine-ring-containing compounds used in them, and more specifically belongs to technical fields of lubricant compositions excellent in low friction properties, in wear resistance under extreme pressure and in sustainability of such properties, and of triazine-ring-containing compounds used in them.

RELATED ART

Performances required for lubricant relate to that it should be able to lower friction coefficient at mechanical friction sliding members over a wide temperature range and pressure range, and that such effects are sustained as long as possible. It is also expected for the lubricant to not only improve lubricating properties between mechanical friction sliding members, but also to thereby good provide wear resistance to such friction sliding members in themselves. Effects, which is brought about by lubricant such as engine oil, of reducing friction coefficient of the friction sliding members and increasing service life thereof directly result in improved fuel cost for mechanical driving, or in other words, energy saving. Elongation of the service life of engine oil not only ensures reduction in waste oil but also reduction in $CO_2$ emission, so that it will be desirable in terms of environmental compatibility which has increasingly been attracting recent public attention. As for bearings or gears, which operate under particularly severe frictional conditions among various sliding members for use in industrial machines, use of conventional lubricant such as lubricating oil or grease may result in film breakage or sticking of the lubricant under particularly severe lubricating conditions, which makes it difficult to obtain a desired low friction coefficient due to abrasion scars. This sometimes lowers the reliability of apparatus, and tends to increase severity of the friction conditions especially for the case that the apparatus is to be downsized, which has been one reason for preventing the apparatus from being downsized. So that there has been a strong demand for a lubricant which can bring about the effects even under severe conditions, can contribute to downsizing of the apparatus, and is excellent in energy saving property.

Lubricants which have previously been used are generally such that comprising a lubricant base oil as a major component, and a lubricant aids such as an organic compound blended thereto. In particular, organic molybdenum compounds recently have attracted an attention as a lubricant auxiliary. Organic molybdenum compounds are excellent in various properties such as wear resistance, durability under extreme pressure (load resistance) and low friction property even during operation of sliding members of a mechanical apparatus under severe frictional conditions such as high temperature, high or low speed, high load, downsizing and weight reduction, so that the compounds have attracted a good deal of attention as a material capable of effectively exhibiting lubricating effects under a marginal lubricating condition which is higher in pressure than the fluid lubricating condition under ordinary pressure.

Although the organic molybdenum compound may exhibit an excellent lubricant effect even under a severe friction condition, it is apparently inappropriate in view of environmental compatibility since the lubricating oil contains a considerable amount of heavy metals such as molybdenum and zinc, sulfide which can readily be oxidized to thereby produce sulfur oxide adversely affecting the lubricating oil or sliding member per se, and even affecting the environment, and phosphoric acid which undesirably eutrophicates rivers and seas. Another disadvantage relates to that molybdenum oxide/sulfide film formed on the sliding surface is gradually peeled off under friction to thereby produce a new film, so that shortage in the amount of either of organic molybdenum compound or organic zinc compound, which are source materials, may sharply lose the effect. A countermeasure of increasing the amount of such organic molybdenum compound and organic zinc compound is however undesirable since it may increase the amount of byproducts generated in the system by such peeling-off of the film, which adversely affect the sliding machinery per se, so that it is less expectable in a current situation of a system using the foregoing organic molybdenum compound to improve fuel cost through elongation of the service life of the lubricant. As has been described in the above, there has been no proposal of a lubricant which is free from any of environmentally hazardous substance or environmental pollutant such as heavy metal elements, phosphate compounds and sulfides, capable of exhibiting excellent lubricating properties, and capable of retaining such properties for a long period.

It has been known that a lubricant composition comprising a triazine-ring-containing compound as a major component has an excellent environmental compatibility or can contribute to improvement of fuel consumption due to long-lasting property, and that the composition exhibits properties enough to be as an extreme pressure agent, friction-coefficient-lowering agent and anti-wear additives (see Japanese Laid-Open Patent Publication No. 2002-69472). Lubricants have been recently required to have more various properties and higher performances with the developments of various high performance machines and with frequent use under severe conditions.

SUMMARY OF THE INVENTION

It is therefore an object of the present invention to provide a lubricant composition capable of exhibiting excellent properties not only in a state of mixture with conventional lubricant base oil, but also in a state not mixed with such lubricant base oil. It is another object of the present invention to provide a lubricant composition capable of retaining low friction property and anti-abrasion property on the sliding surface resistance for a long period, in particular even under extreme pressure. It is still another object of the present invention to provide a lubricant composition excluding environmentally-less-compatible heavy metals, phosphate group and sulfides to thereby concomitantly achieve both of longer service life and environmental compatibility.

It is another object of the present invention to provide a novel triazine-ring-containing compound, in particular capable of exhibiting excellent properties not only in a state of mixture with conventional lubricant base oil, but also in a state not mixed with such lubricant base oil.

The present inventors conducted various studies in order to solve the aforementioned problems of the prior arts, and as a result, they found that compounds having a particular functional segment have excellent lubricant properties. On the basis of this finding, the present invention was achieved.

In one aspect, the present invention provides a lubricant composition comprising at least one compound selected from the group represented by a formula (1);

Formula (1)

Formula (1)

$$(R—X)_m—D$$

where D represents an m-valent cyclic group capable of bonding to "m" of —X—R; Xs respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; Rs respectively represent a substituted or non-substituted alkyl group, alkenyl group, alkynyl group, aryl group or heterocyclic group provided that at least one R contains an ester bond; and m is an integer from 2 to 11.

As embodiments of the present invention, the lubricant composition wherein D is selected from five-, six- or seven-membered heterocyclic groups; the lubricant composition wherein the compound is selected from the group represented by a formula (2);

Formula (2)

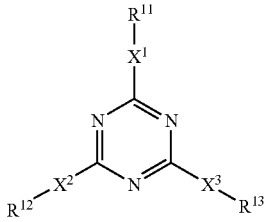

where X , X and X respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; and $R^{11}$, $R^{12}$ and $R^{13}$ respectively represent a substituted or non-substituted alkyl group, alkenyl group, alkynyl group, aryl group or heterocyclic group provided that at least one of $R^{11}$, $R^{12}$ and $R^{13}$ contains an ester bond; and the lubricant composition wherein the compound is selected from the group represented by a formula (3);

Formula (3)

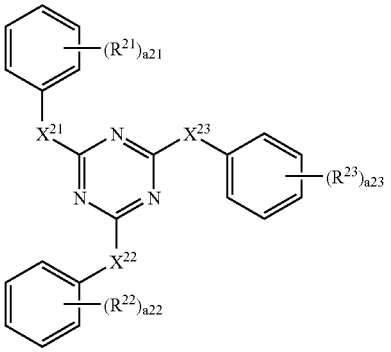

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; $R^{21}$, $R^{22}$ and $R^{23}$ respectively represent a substituent group provided that at least one of $R^{21}$, $R^{22}$ and $R^{23}$ contains an ester bond; and a21, a22 and a23 respectively represent an integer from 1 to 5;

In another aspect, the present invention provides a triazine-ring-containing compound represented by a formula (2);

Formula (2)

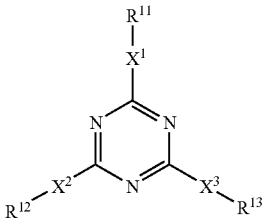

where $X^1$, $X^2$ and $X^3$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; and $R^{11}$, $R^{12}$ and $R^{13}$ respectively represent a substituted or non-substituted alkyl group, alkenyl group, alkynyl group, aryl group or heterocyclic group provided that at least one of $R^{11}$, $R^{12}$ and $R^{13}$ contains an ester bond.

As embodiments of the present invention, the triazine-ring-containing compound represented by a formula (3);

Formula (3)

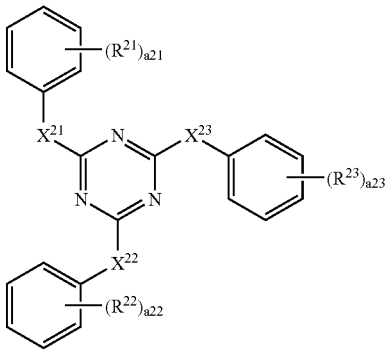

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; $R^{21}$, $R^{22}$ and $R^{23}$ respectively represent a substituent group provided that at least one of $R^{21}$, $R^{22}$ and $R^{23}$ contains an ester bond; and a21, a22 and a23 respectively represent an integer from 1 to 5; the triazine-ring-containing compound wherein at least one of $R^{21}$, $R^{22}$and $R^{23}$ is selected from the group represented by a formula (4);

Formula (4)

$$—L^{01}—(CH_2)_p—\overset{O}{\overset{\|}{C}}—O—(CH_2CH_2O)_q—R^{01}$$

where $L^{01}$ is a bivalent linking group selected from the group consisting of a alkylene group, $NR^1$, where $R^1$ is a hydrogen atom or a $C_{1-30}$ alkyl group, oxygen, sulfur, carbonyl, sulfonyl and any combinations thereof and the bivalent linking group may be substituted or non-substituted; $R^{01}$ is a substituted or non-substituted $C_{1-30}$ alkyl group; and p and q respectively represent an integer; the triazine-ring-containing compound wherein at least one of $R^{21}$, $R^{22}$ and $R^{23}$ is selected from the group represented by a formula (5);

Formula (5)

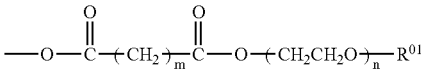

where $R^{01}$ is a substituted or non-substituted $C_{1-30}$ alkyl group, and m and n respectively represent an integer; and the triazine-ring-containing compound wherein at least one of $R^{21}$, $R^{22}$ and $R^{23}$ is selected from the group represented by a formula (6);

Formula (6)

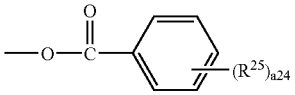

where $R^{25}$ is a substituent group and a24 is an integer from 1 to 5.

DESCRIPTION OF THE PREFERRED EMBODIMENTS

The present invention will be described in detail below.

The lubricant composition of the present invention comprises at least one compound having an m-valent, where m is an integerfrom 2 to 11, and "m" of side chains bonding to the cyclic group. At least one of the side chains contains an ester bond. The compound may exhibit an excellent property enough to be as a lubricant, and thus the lubricant composition of the present invention may consist of the compound. Another embodiment of the present invention relates to a lubricant composition comprising the compound and lubricant base oil. In this embodiment, the compound may contribute to improving lubricant effect.

One of the side chains in the compound contains an ester bond, and desirably contains a group represented by a formula (4a) or (4b). It is noted that the left end of the group shown below bonds to the cyclic group.

Formula (4a)

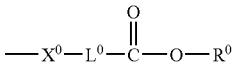

Formula (4b)

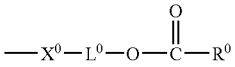

In the formulae, $X^0$ represents a single bond or a bivalent linking group selected from the group consisting of $NR^1$, where $R^1$ is a hydrogen atom or $C_{1-30}$ alkyl group, oxygen, sulfur, carbonyl, sulfonyl or any combinations thereof.

In the formulae, $L^0$ represents a bivalent linking group selected from the group consisting of an alkylene group, $NR^1$, where $R^1$ is a hydrogen atom or $C_{1-30}$ alkyl group, oxygen, sulfur, carbonyl, sulfonyl or any combinations thereof. The bivalent linking group may be substituted or non-substituted. In the specification, the term of "alkylene group" is used for not only any chain alkylene groups but also any cycloalkylene groups. $L^0$ is desirably selected from alkylene groups.

Preferred examples of the combination of $X^0$ and $L^0$, namely —$X^0$-$L^0$- , include —O(C═O)-alkylene- and —O(C═O)-cycloalkylene-.

$R^0$, which is located at the end of the side chain, represents a substituted or non-substituted alkyl group or aryl group.

The compound is more desirably selected from the compounds in which at least one of the side chains contains the group represented by the formula (4a). Among these, when the compound in which at least one of the side chains contains the group represented by the formula (4) is used, both of low friction coefficient and low viscosity can be obtained. It is noted that the left end, namely -$L^{01}$, bonds to the cyclic group.

Formula (4)

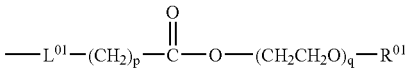

In the formula, $L^{01}$ has the same meaning of $X^0$. $L^{01}$ is desirably selected from the group consisting of oxygen, sulfur, —(C═O)O— and —NH—(C═O)O—. $R^{01}$ is a substituted or non-substituted $C_{1-30}$ alkyl group; and P and q respectively represent an integer. $R^{01}$is desirably selected from substituted or non-substituted $C_{1-25}$ alkyl groups, and more desirably selected from $C_{1-20}$ alkyl groups. Examples of the substituent group for the alkyl group include halogen atoms, alkoxy groups such as methoxy, ethoxy, methoxyethoxy or phenoxy; sulfide groups such as methylthio, ethylthio or propylthio; alkylamino groups such as methylamino or propylamino; acyl groups such as acetyl, propanoyl, octanoyl or benzoyl; acyloxy groups such as acetoxy, pivaloyloxy or benzoyloxy; aryl groups, heterocyclic groups, hydroxyl, mercapto, amino, cyano, nitro, carboxyl, sulfo, carbamoyl, sulfamoyl and ureido. P is desirably an integer selected from 1 to 20, and more desirably selected from 2 to 10. q is desirably an integer selected from 1 to 10, and more desirably selected from 1 to 5.

The compound is also desirably selected from the compounds in which at least one of the side chains contains the group represented by a formula (5) or a formula (6).

Formula (5)

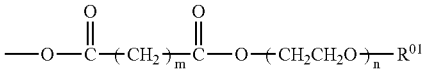

In the formula, $R^{01}$ represents a substituted or non-substituted $C_{1-30}$ alkyl group; and m and n respectively represent an integer.

Formula (6)

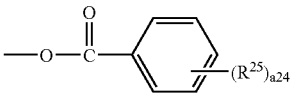

In the formula, $R^{25}$ represents a substituent group and a24 is an integer from 1 to 5.

As mentioned above, the compound which can be used in the present invention is a cyclic compound having at least one side chain containing an ester bond. The compound is desirably selected from discotic compounds. In this specification, the term of "discotic compound" is used for any compounds having a discotic segment in the central portion of a molecule structure. The discotic segment is a central segment without side chain segments, and to use an original. form thereof, namely a hydrogenised compound, as an example, the structural feature of such a central segment can be explained as follows:

A molecular size of a hydrogenised compound, which can be an original form of a discotic compound, may be obtained by 1) to 5) steps.

1) To create a possible planar, desirably an exact planar, molecule structure for a target molecule. For creating, standard bond-length and bond-angle values based on orbital hybridization are desirably used, and such standard values can be obtained with reference to the 15th chapter in the second volume of "Chemical Handbook, revised version 4, Foundation Section (Kagaku Binran Kaitei 4 Kisohen)" compiled by The Chemical Society of Japan, published by MARUZEN in 1993.

2) To optimize a molecular structure using the above-obtained planar structure as a default by molecular orbital method or molecular mechanics method. Examples of such methods include Gaussian92, MOPAC93, CHARMm/QUANTA and MM3, and Gaussian92 is desirably selected.

3) To move a centroid of the optimized structure to an origin position and to create a coordinate having an axis equal to a principal axis of inertia (a principal axis of a inertia tensor ellipsoid).

4) To set a sphere defined by van der Waals radius in each atom positions thereby drawing a molecular structure.

5) To calculate lengths along to three coordinate axes on van der Waals surface thereby obtaining "a", "b" and "c".

Using "a", "b" and "c" obtained trough the steps 1) to 5), "a discotic structure" can be defined as a structure which satisfies $a \geqq b > c$ and $a \geqq b \geqq a/2$, and a preferred example of the discotic structure is a structure which satisfying $a \geqq b > c$ and $a \geqq b \geqq 0.7a$ or $b/2 > c$.

Examples of the hydrogenated compound, which can be an original form of a discotic compound, include mother cores and derivatives described in various literatures such as "Ekisho no Kagaku (Science of Liquid Crystal), edited by the Chemical Society of Japan, Seasonal Chemical Review No.22, Chapter 5, and Chapter 10, Section 2 (1994); C. Destrade et al., Mol. Crysr. Liq. Cryst., vol. 71, p. 111 (1981); B. Kohne et al., Angew. Chem. Vol. 96, p. 70; compounds described in J. M. Lehn et al., J. Chem. Soc. Chem. Commun., p. 1794(1985); and J. Zhang et al., J. Am. Chem. Soc., vol. 116, p. 2655 (1994). More specific examples of the hydrogenated compound include benzene derivatives, tri phenylene derivatives, truxene derivatives, phthalocyanine derivatives, porphyrin derivatives, anthracene derivatives hexaethynylbenzene derivatives, dibenzopyrene derivatives, coronene derivatives and phenylacetylene macrocycl derivatives. The examples also include cyclic compounds described in "Chemical Review (Kagaku Sousetsu) No. 15 Chemistry of Novel Aromatic Series (Atarashii Houkouzoku no Kagaku)" compiled by the Chemical Society of Japan, published by University of Tokyo Press in 1977; and electronic structures such as heteroatom-substituted compounds thereof.

The compound having an ester bond in at least one side chain, which can be used in the lubricant composition of the present invention, is desirably selected from the group represented by a following formula (1).

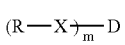

Formula (1)

In the formula, represents an m-valent cyclic group capable of bonding to "m" of —X—R. One preferred molecular structure is such that D is situated in the central position of the molecule and "m" of side chains are radially-arranged from D. Xs respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof. Rs respectively represent a substituted or non-substituted alkyl group, alkenyl group, alkynyl group, aryl group or heterocyclic group provided that at least one R contains an ester bond. m is an integer from 2 to 11.

Examples of the cyclic group represented by D include aryl groups and heterocyclic groups. Examples of the aryl rings in the aryl group include a benzene ring, an indene ring, a naphthalene ring, a triphenylene ring, a fluorine ring, a phenanthrene ring, an anthracene ring and a pyrane ring. The aryl group may be substituted or non-substituted.

The heterocyclic group is desirably selected from 5-, 6- or 7-membered heteroring groups, more desirably from 5- or 6-membered heteroring groups, and much more desirably from 6-membered heteroring groups. One or more heteroatoms forming the heteroring are desirably selected from the group consisting of nitrogen, oxygen and sulfur. Aromatic heterorings are preferred. An aromatic heteroring usually belongs to unsaturated heterorings, and the heterocyclic group is more desirably selected from unsaturated heteroring groups having maximum double bondings. Examples of the heteroring include furan ring, thiophene ring, pyrrole ring, pyrrolidine ring, oxazole ring, isoxazole ring, thiazole ring, isothiazole ring, imidazole ring, imidazoline ring, imidazolidine ring, pyrazole ring, pyrazoline ring, pyrazolidine ring, triazole ring, furazan ring, tetrazole ring, pyrane ring, thyine ring, pyridine ring, piperidine ring, oxazine ring, morpholine ring, thiazine ring, pyridazine ring, pyrimidine ring, pyrazine ring, piperazine ring and triazine ring. Triazine ring is preferred and 1,3,5-triazine ring is more preferred. The heteroring may be condensed with other heteroring, or at least one aliphatic ring or aryl ring. However monocyclic heteroring groups are preferred.

In the formula (1), Xs respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof. When X is a single bond, X may bond directly to nitrogen atom, having free atomic valence, of a heteroring such as a piperidine ring or may bond to a heteroatom not having free atomic valence to form an onium salt such as an oxonium salt, sulfonium salt or ammoniumsalt. Xdesirably represents a sulfur atomor $NR^1$, where $R^1$ represents a hydrogen atom or a $C_3$ or shorter alkyl group.

When R represents an alkyl group, the alkyl group is desirably selected from $C_{1-30}$ alkyl groups, more desirably from $C_{2-30}$ alkyl groups, much more desirably from $C_{4-30}$ alkyl groups and further much more desirably from $C_{6-30}$alkyl groups. The alkyl group may have a linear or branched chain structure and may be substituted or non-substituted. Examples of the substituent group include halogen atoms, alkoxy groups such as methoxy, ethoxy, methoxyethoxy or phenoxy; sulfide groups such as methylthio, ethylthio or propylthio; alkylamino groups such as methylamino or propylamino; acyl groups such as acetyl, propanoyl, octanoyl or benzoyl; acyloxy groups such as acetoxy, pivaloyloxy or benzoyloxy; hydroxyl, mercapto, amino, carboxyl, sulfo, carbamoyl, sulfamoyl and ureido.

When R represents an alkenyl or alkynyl group, their preferred carbon numbers or their preferred structures are as same as those of the alkyl group. The alkenyl or alkynyl group may be substituted or non-substituted with one or more of those exemplified as the substituent group of the alkyl group.

Examples of the aryl group represented by R include phenyl, indenyl, α-naphthyl, β-naphthyl, fluorenyl, phenanthryl, anthracenyl and pyrenyl, and phenyl and naphthyl are preferred. The aryl group may be substituted or non-substituted. Examples of the substituent group include those exemplified above as a substituent group for the alkyl group, and alkyl groups. The substituent group for the aryl group is desirably selected from substituents having a $C_8$ or longer linear or branched alkyl group, and preferred examples of such substituent include alkyl groups such as octyl, decyl, hexadecyl or 2-ethylhexyl; alkoxy groups such as dodecyloxy or hexadecyloxy; sulfide groups such as hexadecylthio; substituted amino groups such as heptadecylamino; octylcarbamoyl, octanoyl and decylsulfamoyl. The aryl group desirably has two or more substituent groups selected from these. And the aryl group may also be substituted by other substituent groups such as a halogen atom, hydroxyl, cyano, nitro, carboxyl, sulfo or the like, besides the foregoing substituents.

When R represents a heterocyclic group, the heterocyclic group is preferably selected from five- to seven-membered heterocyclic groups, more preferably selected from five- or six-membered groups, and most preferably selected from six-membered groups, similarly to D. Specific examples of such skeletons can be found in heterocycles listed in "Iwanami Rikagaku Jiten (Iwanami's Physicochemical Dictionary; Iwanami Shoten, Publishers), the 3rd edition, supplement Chapter 11"Nomenclature for Organic Chemistry", Table 4 "Names of Principal Hetero Monocyclic Compounds" on page 1606, and Table 5 "Names of Principal Condensed Heterocyclic Compounds" on page 1607. The heterocyclic groups are, similarly to the foregoing aryl group, preferably substituted with a substituent containing a $C_8$or longer linear or branched alkyl chain, where substitution by two or more groups is more preferable. Specific examples of the substituent containing such chain are same as those described in the above. The heterocyclic group may also be substituted by halogen atom, hydroxyl, cyano, nitro, carboxyl, sulfo or the like, besides the foregoing substituents.

In the formula (1), at least one of Rs contains an ester bond, desirably contains a segment represented by the formula (4a) or (4b), more desirably contains a segment represented by the formula (4a), and most desirably contains a segment represented by the formula (4). In the formula (1), "m" is an integer from 2 to 11, and desirably not smaller than 3. When m is not smaller than 2, plurality of X and R may be same or different each other.

Among compounds represented by the formula (1), the compounds represented by the following formula (2) are preferred.

Formula (2)

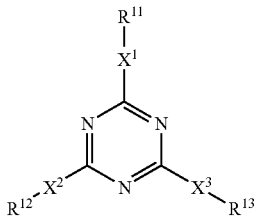

In the formula (2), $X^1$, $X^2$ and $X^3$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof.

When $X^1$, $X^2$ or $X^3$ represents a single bond, they may bond directly to nitrogen atom, having free atomic valence, of a heteroring such as a piperidine ring, or may bond to a heteroatom not having free atomic valence to form an onium salt such as an oxonium salt, sulfonium salt or ammonium salt. On the other hand, when $X^1$, $X^2$ or $X^3$is not a single bond, they respectively represent a bivalent inking group selected from the group consisting of $NR^1$, where $R^1$ is a hydrogen atom or a $C_{1-30}$ alkyl group, oxygen, sulfur, carbonyl, sulfonyl and any combinations thereof, and examples of such bivalent linking group include oxycarbonyl, aminocarbonyl, ureylene, oxysulfonyl and sulfamoyl. As the linking group, sulfur or $NR^1$, where $R^1$ is a hydrogen atom or a $C_3$ or shorter alkyl group, is preferred, and imino, —NH—, is more preferred.

In the formula (2), $R^{11}$ , $R^{12}$ and $R^{13}$ respectively represent a substituted or non-substituted alkyl group, alkenyl group, alkynyl group, aryl group or heterocyclic group provided that at least one of $R^{11}$, $R^{12}$ and $R^{13}$ contains an ester bond. The alkyl group represented by $R^{11}$, $R^{12}$ or $R^{13}$ is desirably selected from $C_{1-30}$ alkyl groups, more desirably from $C_{2-30}$ alkyl groups, much more desirably from $C_{4-30}$ alkyl groups and further much more desirably from $C_{6-30}$ alkyl groups. The alkyl group may have a linear or branched chain structure and may be substituted or non-substituted. Examples of the substituent groups include halogen atoms, alkoxy groups such as methoxy, ethoxy, methoxyethoxy or phenoxy; sulfide groups such as methylthio, ethylthio or propylthio; alkylamino groups such as methylamino or propylamino; acyl groups such as acetyl, propanoyl, octanoyl or benzoyl; acyloxy groups such as acetoxy, pivaloyloxy or benzoyloxy; hydroxyl, mercapto, amino, carboxyl, sulfo, carbamoyl, sulfamoyl and ureido.

When $R^{11}$, $R^{12}$or $R^{13}$ represents an alkenyl or alkynyl group, their preferred carbon numbers or their preferred structures are as same as those of the alkyl group. The alkenyl or alkynyl group may be substituted or non-substituted with one or more of those exemplified as the substituent group of the alkyl group.

The aryl group represented by $R^{11}$, $R^{12}$ or $R^{13}$ is desirably selected from $C_{6-50}$ aryl groups, more desirably selected from $C_{6-40}$ aryl groups and much more desirably from $C_{6-30}$ aryl groups. Examples of the aryl group include phenyl, indenyl, a-naphthyl, β-naphthyl, fluorenyl, phenanthryl, anthracenyl and pyrenyl, and phenyl and naphthyl are preferred. The aryl group may be substituted or non-substituted. Examples of the substituent groups include those exemplified above as a substituent group for the alkyl group, and alkyl groups. The substituent group for the aryl group is desirably selected from substituents having a $C_8$ or longer linear or branched alkyl group, and preferred examples of such substituent include alkyl groups such as octyl, decyl, hexadecyl or 2-ethylhexyl; alkoxy groups such as dodecyloxy, hexadecyloxy, 2-hexyldecyloxy or hexyloxyethyleneoxyethyleneoxy; sulfide groups such as hexadecylthio; substituted amino groups such as heptadecylamino; octylcarbamoyl, octanoyl and decylsulfamoyl. The aryl group desirably has tow or more substituent groups selected from these. And the aryl group may also be substituted by other substituent groups such as a halogen atom, hydroxyl, cyano, nitro, carboxyl, sulfo or the like, besides the foregoing substituents.

When $R^{11}$, $R^{12}$ or $R^{13}$ represents a heterocyclic group, the heterocyclic group is preferably selected from five- to seven-membered heterocyclic groups, more preferably selected from five- or six-membered groups, and most preferably selected from six-membered groups, similarly to D. Specific examples of such skeletons can be found in heterocycles listed in "Iwanami Rikagaku Jiten (Iwanami's Physicochemical Dictionary; Iwanami Shoten, Publishers), the 3rd edition, supplement Chapter 11 "Nomenclature for Organic Chemistry", Table 4 "Names of Principal Hetero Monocyclic Compounds" on page 1606, and Table 5 "Names of Principal Condensed Heterocyclic Compounds" on page 1607. The heterocyclic groups are, similarly to the foregoing aryl group, preferably substituted with a substituent containing a CB or longer linear or branched alkyl chain, where substitution by two or more groups is more preferable. Specific examples of the substituent containing such chain are same as those described in the above. The heterocyclic group may also be substituted by halogen atom, hydroxyl, cyano, nitro, carboxyl, sulfo or the like, besides the foregoing substituents.

At least one of $R^{11}$, $R^{12}$ and $R^{13}$ contains an ester bond, desirably contains a segment represented by the formula (4a) or (4b), more desirably contains a segment represented by the formula (4a), and most desirably contains a segment represented by the formula (4). It is preferred that all of $R^{11}$, $R^{12}$ contain at least one ester bond.

Among the compounds represented by the formula (2), the compounds represented by the following formula (3) are preferred.

Formula (3)

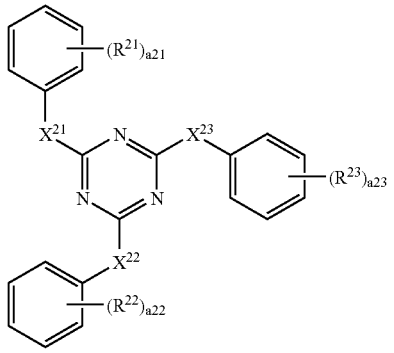

In the formula, $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof. $R^{21}$, $R^{22}$ and $R^{23}$ respectively represent a substituent group provided that at least one of $R^2$ , $R^{22}$ and $R^{23}$ contains an ester bond; and a21, a22 and a23 respectively represent an integer from 1 to 5.

When $X^{21}$, $X^{22}$ or $X^{23}$ represents a single bond, they may bond directly to nitrogen atom, having free atomic valence, of a heteroring such as a piperidine ring, or may bond to a heteroatom not having free atomic valence to form an onium salt such as an oxonium salt, sulfonium salt or ammonium salt. On the other hand, when $X^{21}$, $X^{22}$ or $X^{23}$ is not a single bond, they respectively represent a bivalent inking group selected from the group consisting of $NR^1$, where $R^1$ is a hydrogen atom or a $C_{1-30}$ alkyl group, oxygen, sulfur, carbonyl, sulfonyl and any combinations thereof, and examples of such bivalent linking group include oxycarbonyl, aminocarbonyl, ureylene, oxysulfonyl or sulfamoyl. As the linking group, sulfur or $NR^1$, where $R^1$ is a hydrogen atom or a $C_3$ or shorter alkyl group, is preferred, and imino, —NH—, is more preferred.

Examples of the substituent group represented by $R^{21}$, $R^{22}$ and $R^{23}$ include halogen atoms, alkyl groups, alkenyl groups, alkynyl groups, aryl groups, heterocyclic groups, cyano, hydroxyl, nitro, carboxyl, alkoxy groups, aryloxy groups, silyloxy groups, heteroxy groups, acyloxy groups, carbamoyloxy groups, alkoxycarbonyloxy groups, aryloxycarbonyloxy groups, amino groups, acylamino groups, aminocarbonylamino groups, alkoxycarbonylamino groups, aryloxycarbonylamino groups, sulfamoylamino groups, alkyl- or aryl-sulfonylamino groups, mercapto, alkylthio groups, arylthio.groups, heterocyclic-thio groups, sulfamoyl groups, sulfo, alkyl- or aryl-sulfinyl groups, alkyl- or aryl-sulfonyl groups, acyl groups, aryloxycarbonyl groups, alkoxycarbonyl groups, carbamoyl groups, aryl- or heterocyclic-azo groups, imido, phosphino, phosphinyl, phosphinyloxy, phosphinylamino and silyl. Examples of the substituent group represented by $R^{21}$, $R^{22}$ or $R^{23}$also include those substituent groups substituted by at least one of the above exemplified substituent groups. At least one of $R^{21}$, $R^{22}$ and $R^{23}$ contains an ester bond, and at least one of $R^{21}$, $R^{22}$ and $R^{23}$ is desirably selected from alkoxy groups which are substituted by a substituent group containing a linear or branched alkyl group containing an ester bond.

The number of carbon atoms of $R^{21}$, $R^{22}$ or $R^{23}$ is desirably from 1 to 30, and more desirably from 1 to 20.

At least one of $R^{21}$, $R^{22}$ and $R^{23}$ contains an ester bond, desirably contains a segment represented by the formula (4a) or (4b), more desirably contains a segment represented by the formula (4a), and most desirably contains a segment represented by the formula (4). It is preferred that all of $R^{11}$, $R^{12}$ contain at least one ester bond. It is also preferred that one of, more preferably all of, $R^{21}$, $R^{22}$ and $R^{23}$ is selected from the group represented by the formula (5) or (6).

In the formulae (4) and (5), $R^{01}$ is a substituted or non-substituted $C_{1-30}$ alkyl group, and m and n respectively represent an integer. $R^{01}$ is desirably selected from substituted or non-substituted $C_{1-25}$ alkyl groups and more desirably selected from substituted or non-substituted $C_{1-20}$alkyl groups. Examples of the substituent group include halogen atoms, alkoxy groups such as methoxy, ethoxy, methoxyethoxy or phenoxy; sulfide groups such as methylthio, ethylthio or propylthio; alkylamino groups such as methylamino or propylamino; acyl groups such as acetyl, propanoyl, octanoyl or benzoyl; acyloxy groups such as acetoxy, pivaloyloxy or benzoyloxy; aryl groups, heterocyclic groups, hydroxyl, mercapto, amino, cyano, nitro, carboxyl, sulfo, carbamoyl, sulfamoyl and ureido. The m is desirably an integer from 1 to 20 and more desirably from 2 to 20. The n is desirably from 0 to 10 and more desirably from 0 to 5.

In the formula (6), examples of the substituent group represented by $R^{25}$ include halogen atoms, alkyl groups, alkenyl groups, alkynylgroups, arylgroups, heterocyclicgroups, cyano, hydroxyl, nitro, carboxyl, alkoxy groups, aryloxy groups, silyloxy groups, heteroxy groups, acyloxy groups, carbamoyloxy groups, alkoxycarbonyloxy groups, aryloxycarbonyloxy groups, amino, acylamino groups, aminocarbonylamino groups, alkoxyaminocarbonylamino groups, aryloxycarbonylamino groups, sulfamoylamino groups, alkyl-or aryl-sulfonylamino groups, mercapto, alkylthio groups, arylthio groups, heterocyclic-thio groups, sulfamoyl, sulfo, alkyl-oraryl-sulfinyl groups, alkyl- or aryl-sulfonyl groups, acyl groups, aryloxycarbonyl groups, alkoxycarbonyl groups, carbamoyl, aryl- or heterocyclic-azo groups, imido, phosphino, phosphinyl, phosphinyloxy, phosphinylamino and silyl. Examples of the substituent group represented by $R^{25}$ also include those substituent groups substituted by at least one of the above exemplified substituent groups. $R^{25}$ is desirably selected from alkoxy groups which are substituted by a substituent group containing a linear or branched alkyl group. a24 is an integer from 1 to 5, and desirably from 1 to 3. The number of carbon atoms of $R^{25}$ is desirably from 1 to 40 and more desirably from 1 to 20.

The following paragraphs will describe specific examples of the compound represented by the formula (1). It is to be noted, however, the present invention is by no means limited by such examples.

$(R—X)_m D$

| | D | m | X | R |
|---|---|---|---|---|
| N-21 | 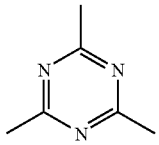 | 3 | —NH— | 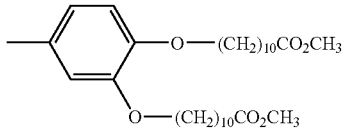 |
| N-22 | 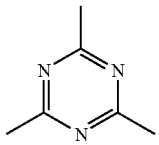 | 3 | —NH— | 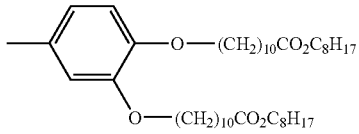 |
| N-23 | 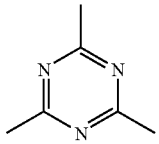 | 3 | —NH— | 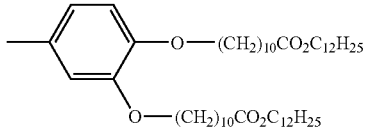 |
| N-24 | 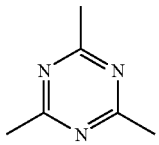 | 3 | —NH— | 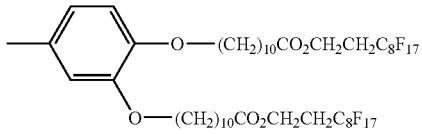 |
| N-25 | 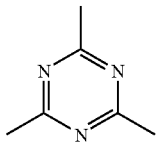 | 3 | —NH— | 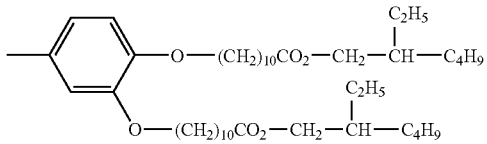 |
| N-26 | 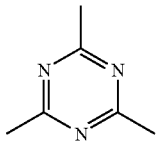 | 3 | —NH— | 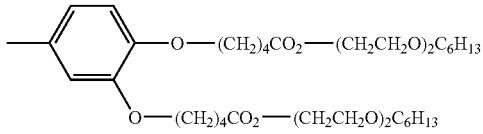 |
| N-27 | 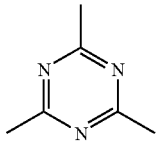 | 3 | —NH— | 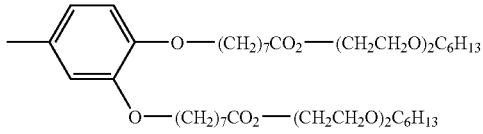 |
| N-28 | 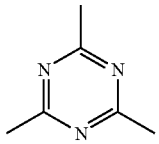 | 3 | —NH— | 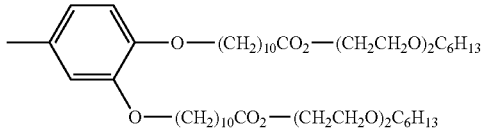 |

-continued
$(R—X)_m—D$
| | D | m | X | R |
|---|---|---|---|---|
| N-29 | 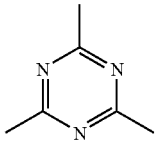 | 3 | —N(H)— | 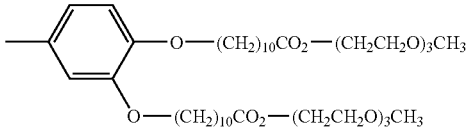 |
| N-30 | 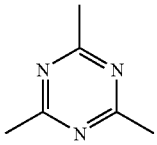 | 3 | —N(H)— | 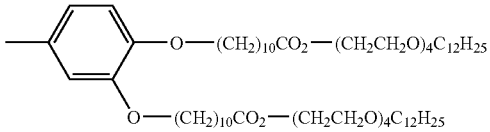 |
| N-31 | 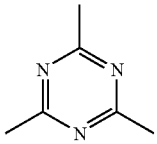 | 3 | —N(H)— | 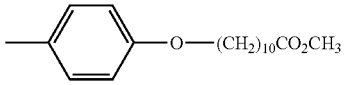 |
| N-32 | 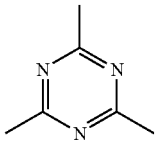 | 3 | —N(H)— | 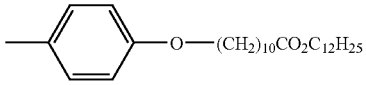 |
| N-33 | 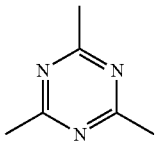 | 3 | —N(H)— | 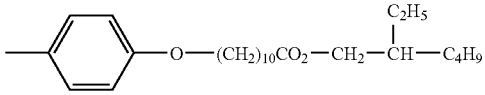 |
| N-34 | 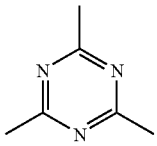 | 3 | —N(H)— | 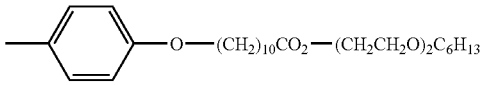 |
| N-35 | 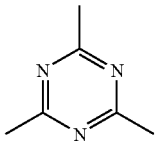 | 3 | —N(H)— | 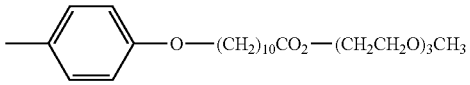 |
| S-21 | 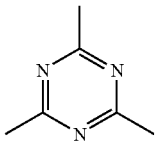 | 3 | —S— | 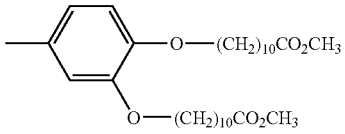 |
| S-22 | 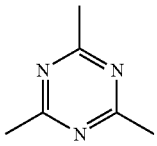 | 3 | —S— | 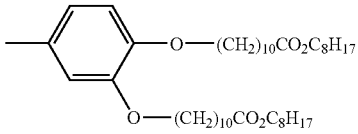 |

-continued
$(R—X)_m—D$
| | D | m | X | R |
|---|---|---|---|---|
| S-23 | 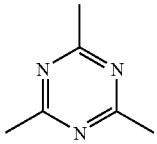 | 3 | —S— | 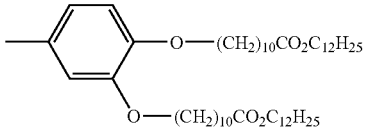 |
| S-24 | 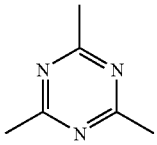 | 3 | —S— | 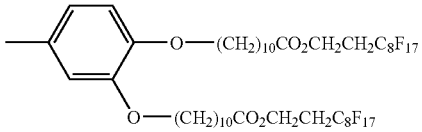 |
| S-25 | 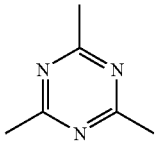 | 3 | —S— | 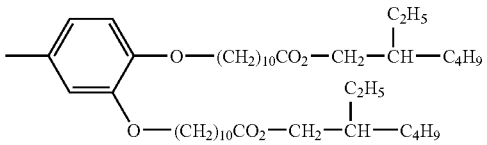 |
| S-26 | 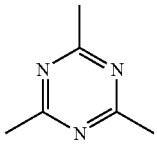 | 3 | —S— | 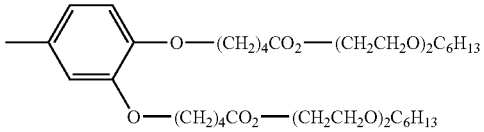 |
| S-27 | 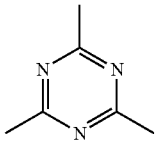 | 3 | —S— | 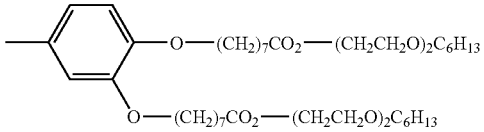 |
| S-28 | 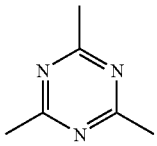 | 3 | —S— | 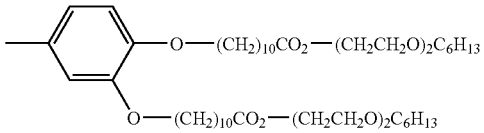 |
| S-29 | 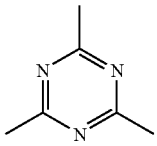 | 3 | —S— | 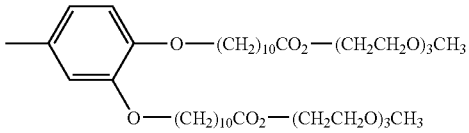 |
| S-30 | 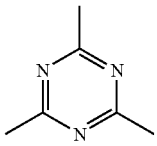 | 3 | —S— | 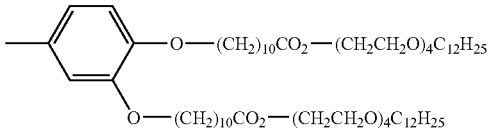 |
| S-31 | 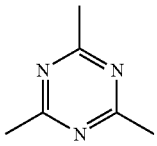 | 3 | —S— | 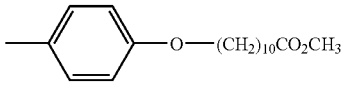 |

-continued
$(R—X)_m—D$
| | D | m | X | R |
|---|---|---|---|---|
| S-32 | 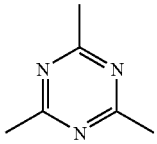 | 3 | —S— | 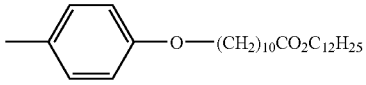 |
| S-33 | 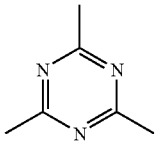 | 3 | —S— | 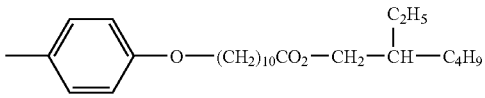 |
| S-34 | 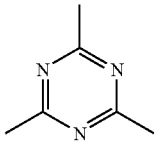 | 3 | —S— | 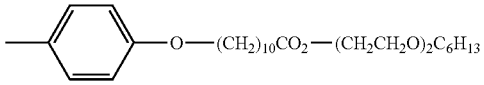 |
| S-35 | 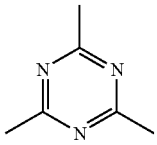 | 3 | —S— | 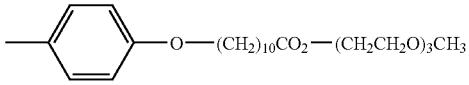 |
| N-1 | 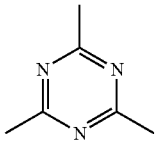 | 3 | —NH— | $—(CH_2)_{10}CO_2CH_3$ |
| N-2 | 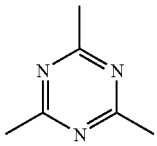 | 3 | —NH— | $—(CH_2)_{10}CO_2C_8H_{17}$ |
| N-3 | 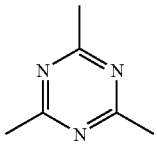 | 3 | —NH— | $—(CH_2)_{10}CO_2C_{12}H_{25}$ |
| N-4 | 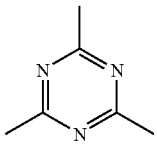 | 3 | —NH— | $—(CH_2)_{10}CO_2CH_2CH_2C_8F_{17}$ |
| N-5 | 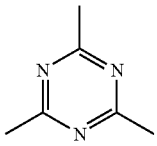 | 3 | —NH— | 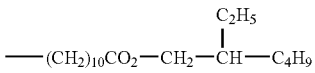 |

-continued
$(R—X)_m—D$
| | D | m | X | R |
|---|---|---|---|---|
| N-6 | 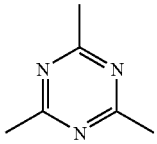 | 3 | —N(H)— | $—(CH_2)_4CO_2—(CH_2CH_2O)_2C_6H_{13}$ |
| N-7 | 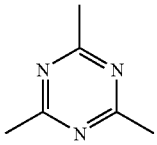 | 3 | —N(H)— | $—(CH_2)_7CO_2—(CH_2CH_2O)_2C_6H_{13}$ |
| N-8 | 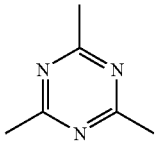 | 3 | —N(H)— | $—(CH_2)_{10}CO_2—(CH_2CH_2O)_2C_6H_{13}$ |
| N-9 | 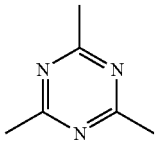 | 3 | —N(H)— | $—(CH_2)_{10}CO_2—(CH_2CH_2O)_3CH_3$ |
| N-10 | 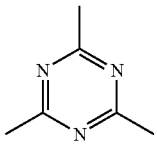 | 3 | —N(H)— | $—(CH_2)_{10}CO_2—(CH_2CH_2O)_4C_{12}H_{25}$ |
| S-1 | 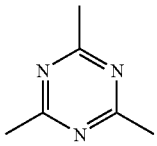 | 3 | —S— | $—(CH_2)_{10}CO_2CH_3$ |
| S-2 | 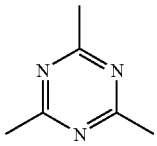 | 3 | —S— | $—(CH_2)_{10}CO_2C_8H_{17}$ |
| S-3 | 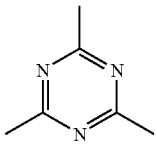 | 3 | —S— | $—(CH_2)_{10}CO_2C_{12}H_{25}$ |
| S-4 | 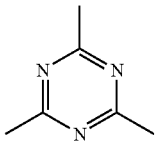 | 3 | —S— | $—(CH_2)_{10}CO_2CH_2CH_2C_8F_{17}$ |

-continued
$(R—X\rightarrow_m D)$
| | D | m | X | R |
|---|---|---|---|---|
| S-5 | 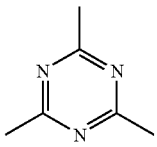 | 3 | —S— | $—(CH_2)_{10}CO_2—CH_2—CH(C_2H_5)—C_4H_9$ |
| S-6 | 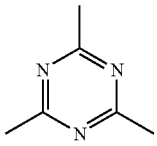 | 3 | —S— | $—(CH_2)_4CO_2—(CH_2CH_2O)_2C_6H_{13}$ |
| S-7 | 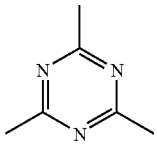 | 3 | —S— | $—(CH_2)_7CO_2—(CH_2CH_2O)_2C_6H_{13}$ |
| S-8 | 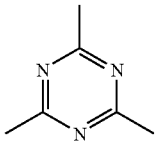 | 3 | —S— | $—(CH_2)_{10}CO_2—(CH_2CH_2O)_2C_6H_{13}$ |
| S-9 | 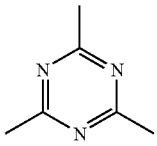 | 3 | —S— | $—(CH_2)_{10}CO_2—(CH_2CH_2O)_3CH_3$ |
| S-10 | 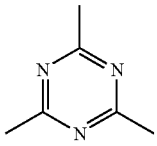 | 3 | —S— | $—(CH_2)_{10}CO_2—(CH_2CH_2O)_4C_{12}H_{25}$ |
| B-1 | 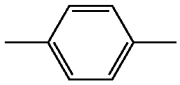 | 2 | —O— | $—(CH_2)_{10}CO_2C_8H_{17}$ |
| B-2 | 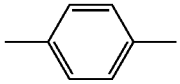 | 2 | 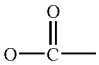 | 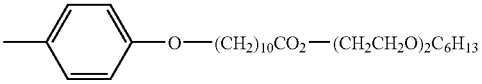 |
| B-3 | 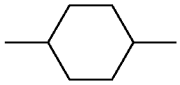 | 2 | 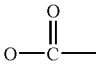 | 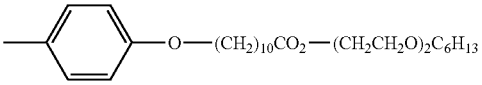 |
| B-4 | 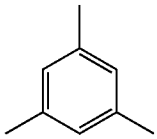 | 3 | —O— | $—(CH_2)_7CO_2—(CH_2CH_2O)_2C_6H_{13}$ |

-continued
$(R—X)_m—D$
| | D | m | X | R |
|---|---|---|---|---|
| B-5 | 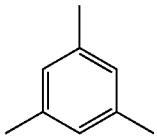 | 3 | —O— | $—(CH_2)_{10}CO_2—(CH_2CH_2O)_2C_6H_{13}$ |
| B-6 | 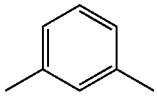 | 3 | 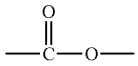 | $—(CH_2)_{10}CO_2—(CH_2CH_2O)_3CH_3$ |
| B-7 | 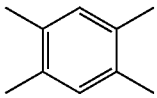 | 4 | —S— | 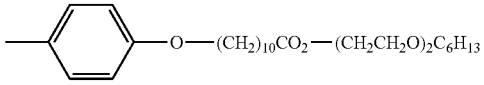 |
| B-8 | 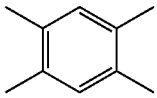 | 4 | —O— | $—(CH_2)_{10}CO_2—(CH_2CH_2O)_2C_6H_{13}$ |
| B-9 | 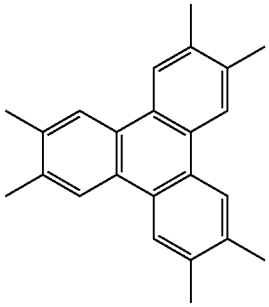 | 6 | —O— | $—(CH_2)_{10}CO_2—(CH_2CH_2O)_2C_6H_{13}$ |
| B-10 | 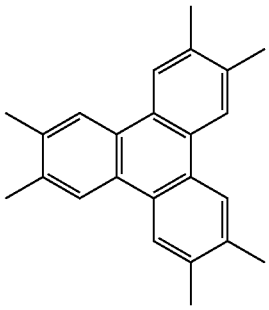 | 6 | 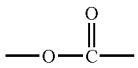 | 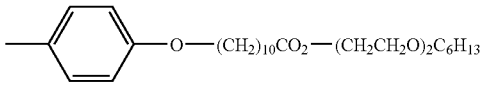 |
| L-1 | 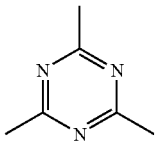 | 3 | 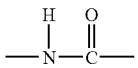 | 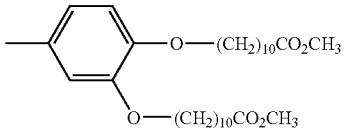 |
| L-2 | 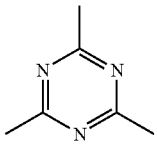 | 3 | 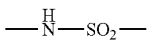 | 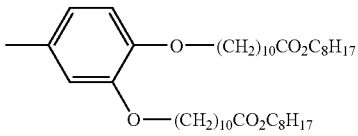 |

-continued
$(R-X)_m-D$
| | D | m | X | R |
|---|---|---|---|---|
| L-3 | 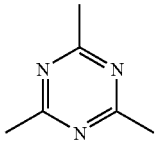 | 3 | 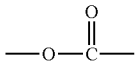 | 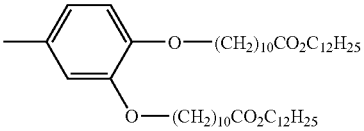 |
| L-4 | 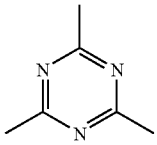 | 3 | 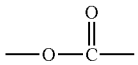 | 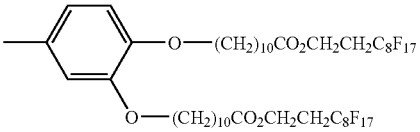 |
| L-5 | 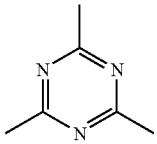 | 3 | 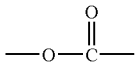 | 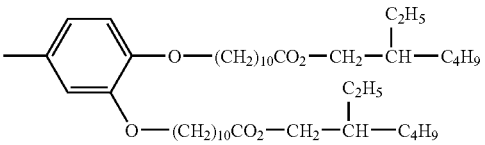 |
| L-6 | 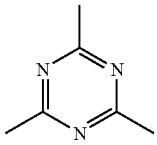 | 3 | —O— | 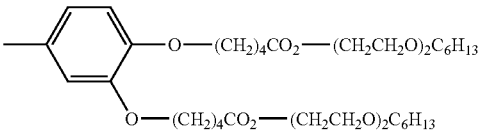 |
| L-7 | 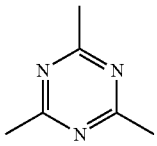 | 3 | —O— | 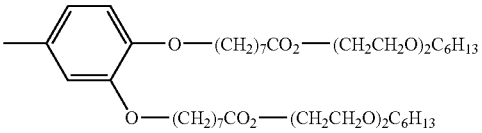 |
| L-8 | 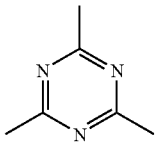 | 3 | —O— | 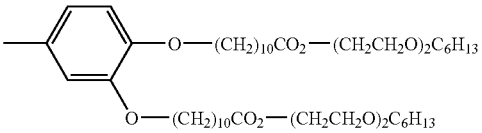 |
| L-9 | 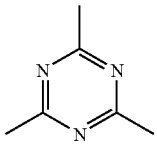 | 3 | —O— | 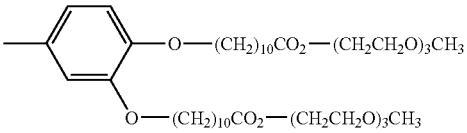 |
| L-10 | 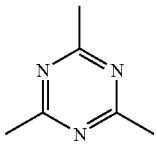 | 3 | —O— | 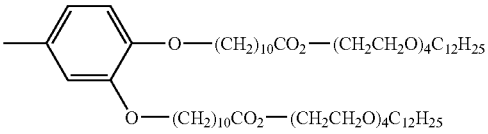 |
| L-11 | 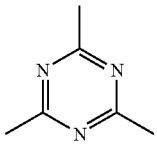 | 3 | 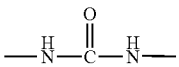 | 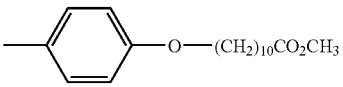 |

-continued
$(R—X\rangle_m—D)$
| | D | m | X | R |
|---|---|---|---|---|
| L-12 | 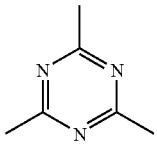 | 3 | 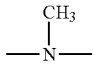 | 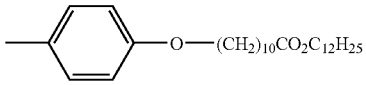 |
| L-13 | 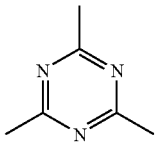 | 3 | 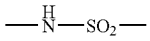 | 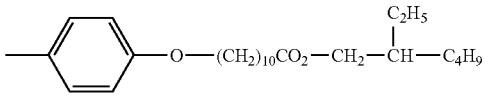 |
| L-14 | 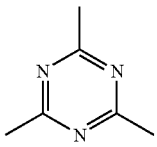 | 3 | —O— | 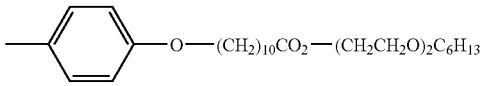 |
| L-15 | 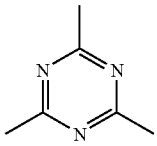 | 3 | —O— | 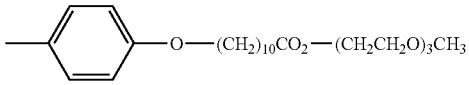 |
| H-1 | 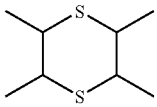 | 4 | —S— | $—(CH_2)_{10}CO_2CH_3$ |
| H-2 | 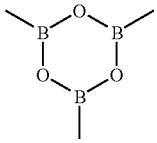 | 3 | — | $—(CH_2)_{10}CO_2C_8H_{17}$ |
| H-3 | 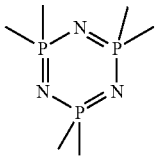 | 6 | —O— | 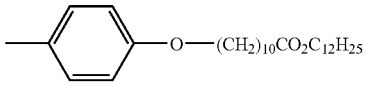 |
| H-4 | 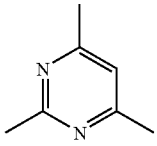 | 3 | 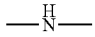 | $—(CH_2)_{10}CO_2—(CH_2CH_2O)_2C_6H_{13}$ |
| H-5 | 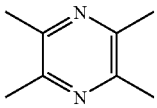 | 4 | 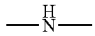 | $—(CH_2)_{10}CO_2—(CH_2CH_2O)_2C_6H_{13}$ |

-continued
$(R—X)_m—D$
| | D | m | X | R |
|---|---|---|---|---|
| E-1 | 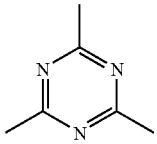 | 3 | —N(H)— | 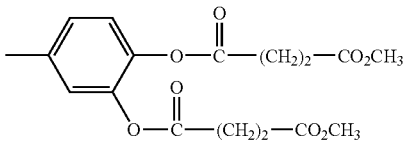 |
| E-2 | 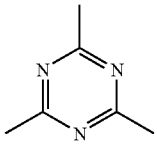 | 3 | —N(H)— | 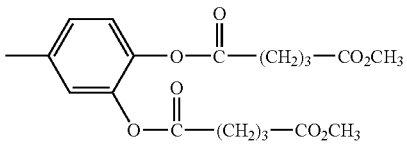 |
| E-3 | 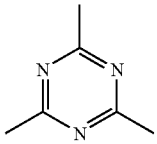 | 3 | —N(H)— | 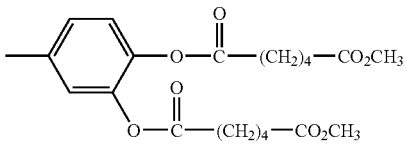 |
| E-4 | 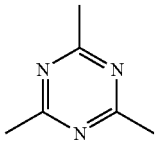 | 3 | —N(H)— | 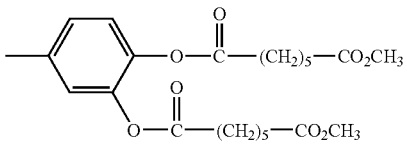 |
| E-5 | 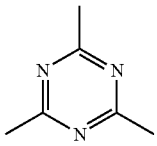 | 3 | —N(H)— | 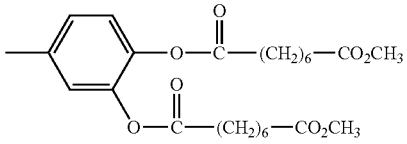 |
| E-6 | 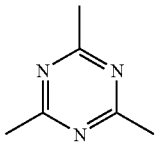 | 3 | —N(H)— | 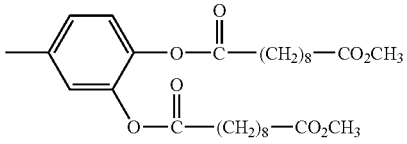 |
| E-7 | 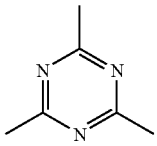 | 3 | —N(H)— | 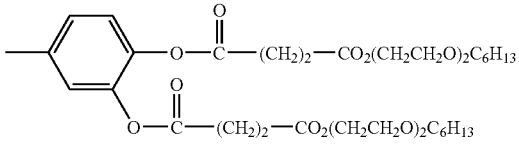 |
| E-8 | 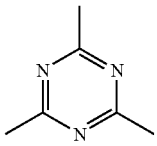 | 3 | —N(H)— | 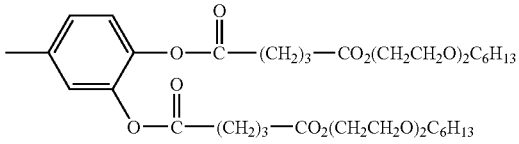 |
| E-9 | 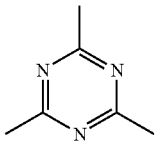 | 3 | —N(H)— | 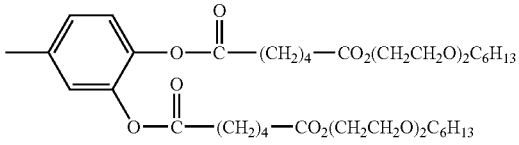 |

-continued
$(R—X\rightarrow_m D)$
| | D | m | X | R |
|---|---|---|---|---|
| E-10 | 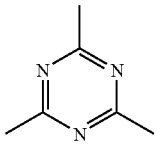 | 3 | —NH— | 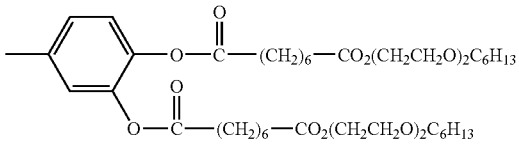 |
| E-11 | 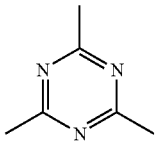 | 3 | —NH— | 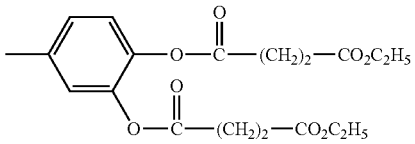 |
| E-12 | 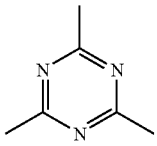 | 3 | —NH— | 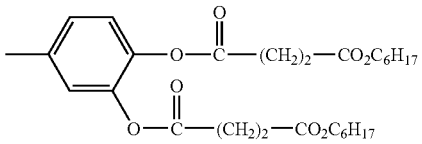 |
| E-13 | 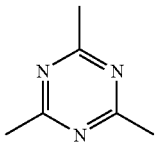 | 3 | —NH— | 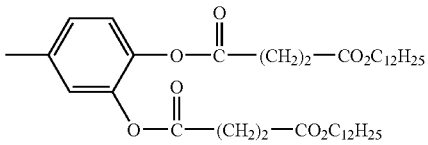 |
| E-14 | 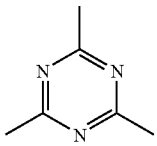 | 3 | —NH— | 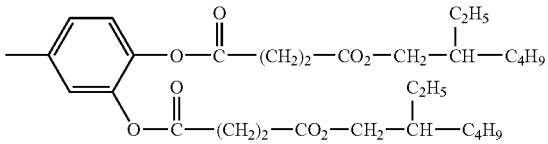 |
| E-15 | 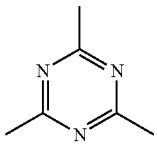 | 3 | —NH— | 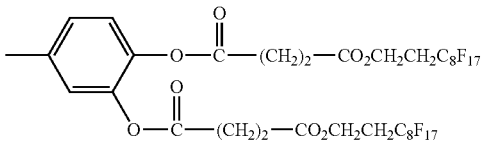 |
| E-16 | 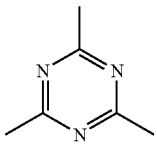 | 3 | —NH— | 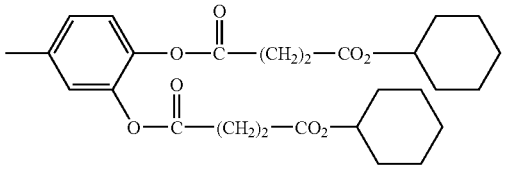 |
| E-17 | 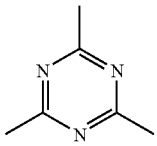 | 3 | —NH— | 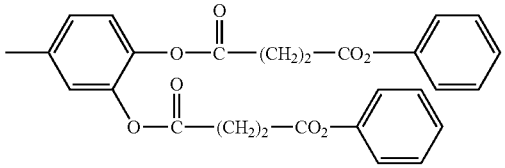 |
| E-18 | 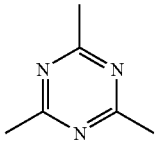 | 3 | —NH— | 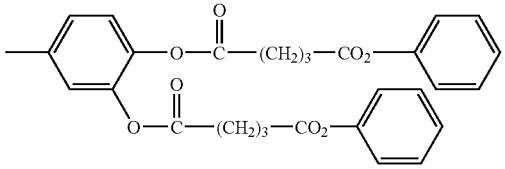 |

-continued
$(R—X\frac{}{}_m D)$
| | D | m | X | R |
|---|---|---|---|---|
| E-19 | 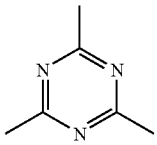 | 3 | —N(H)— | 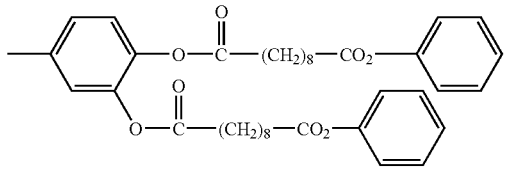 |
| E-20 | 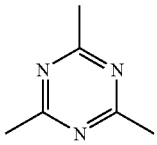 | 3 | —N(H)— | 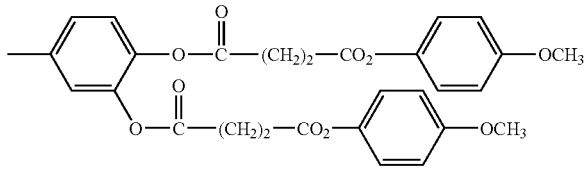 |
| E-21 | 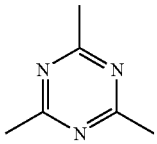 | 3 | —N(H)— | 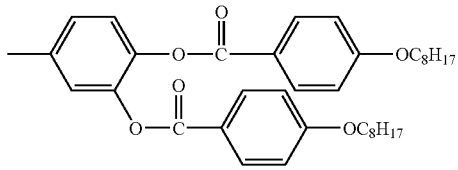 |
| E-22 | 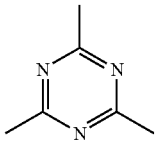 | 3 | —N(H)— | 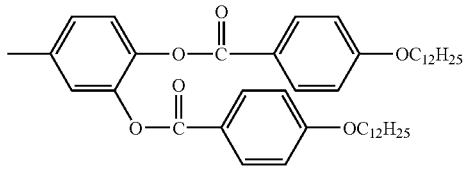 |
| E-23 | 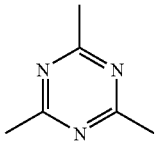 | 3 | —N(H)— | 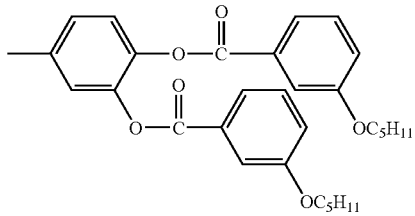 |
| E-24 | 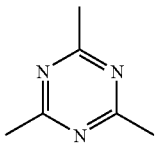 | 3 | —N(H)— | 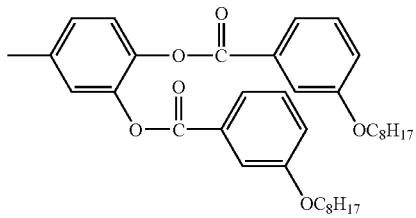 |
| E-25 | 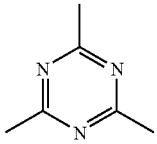 | 3 | —N(H)— | 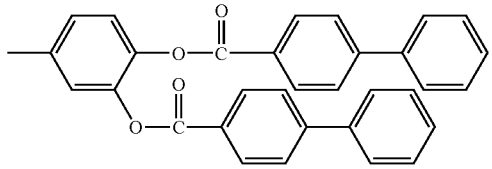 |

-continued
$(R—X\rightarrow_m D)$
| | D | m | X | R |
|---|---|---|---|---|
| E-26 | 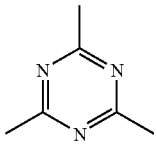 | 3 | —NH— | 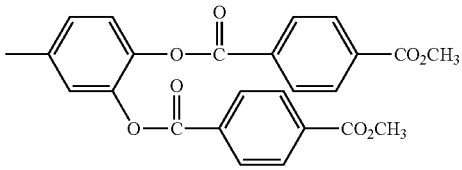 |
| E-27 | 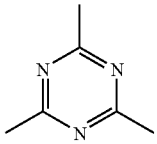 | 3 | —NH— | 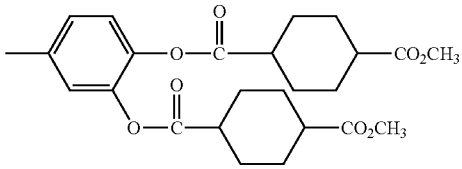 |
| E-28 | 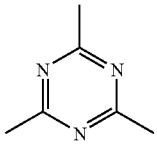 | 3 | —NH— | 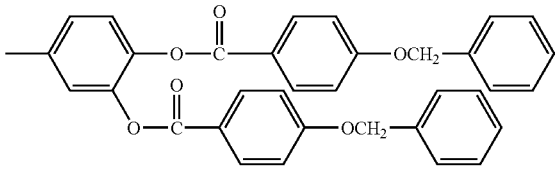 |
| E-29 | 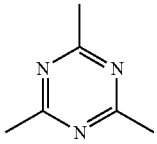 | 3 | —NH— | 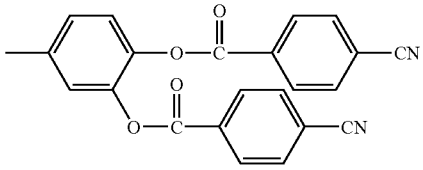 |
| E-30 | 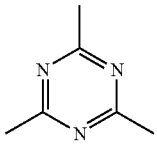 | 3 | —NH— | 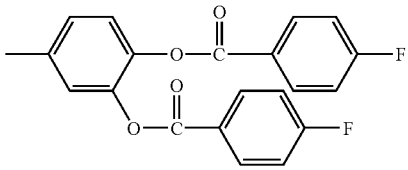 |
| E-31 | 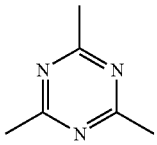 | 3 | —NH— | 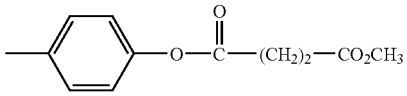 |
| E-32 | 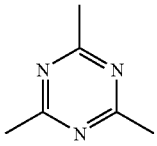 | 3 | —NH— | 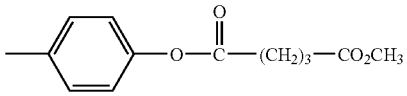 |
| E-33 | 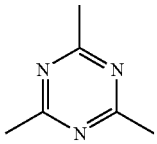 | 3 | —NH— | 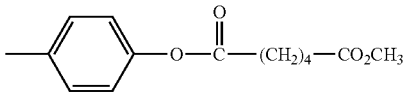 |

-continued
$(R—X)_m—D$
| | D | m | X | R |
|---|---|---|---|---|
| E-34 | 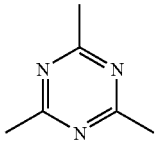 | 3 | —N(H)— | 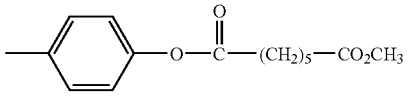 |
| E-35 | 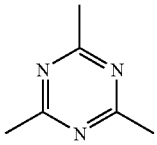 | 3 | —N(H)— | 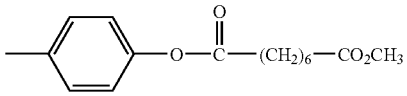 |
| E-36 | 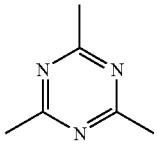 | 3 | —N(H)— | 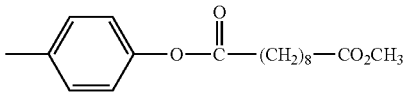 |
| E-37 | 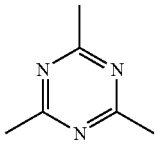 | 3 | —N(H)— | 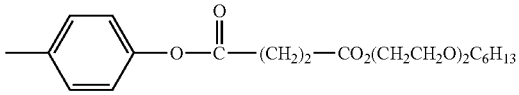 |
| E-38 | 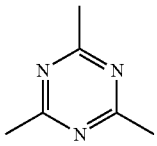 | 3 | —N(H)— | 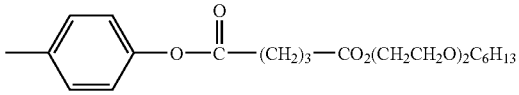 |
| E-39 | 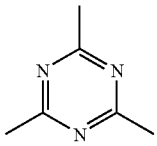 | 3 | —N(H)— | 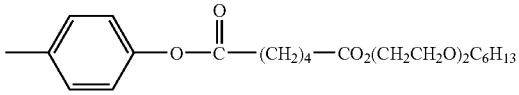 |
| E-40 | 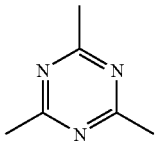 | 3 | —N(H)— | 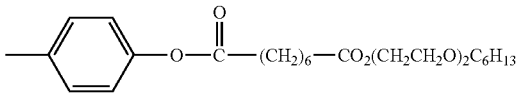 |
| E-41 | 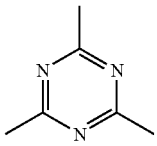 | 3 | —N(H)— | 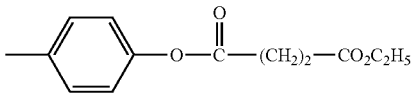 |
| E-42 | 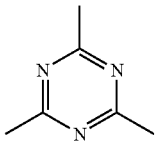 | 3 | —N(H)— | 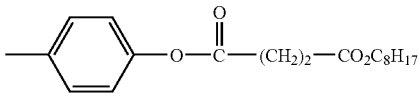 |

-continued
$(R-X)_m-D$
| | D | m | X | R |
|---|---|---|---|---|
| E-43 | 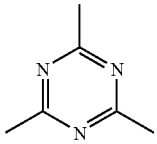 | 3 | —N(H)— | 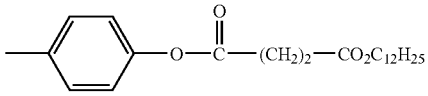 |
| E-44 | 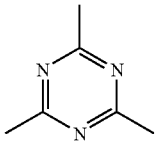 | 3 | —N(H)— | 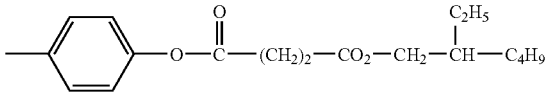 |
| E-45 | 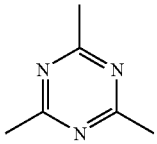 | 3 | —N(H)— | 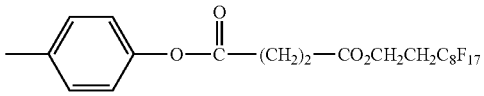 |
| E-46 | 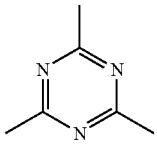 | 3 | —N(H)— | 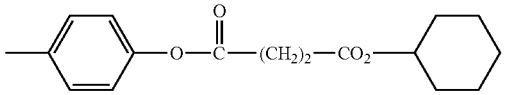 |
| E-47 | 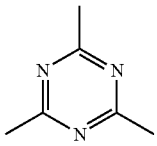 | 3 | —N(H)— | 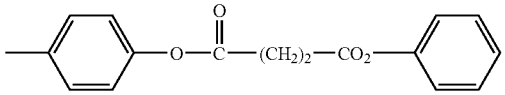 |
| E-48 | 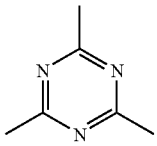 | 3 | —N(H)— | 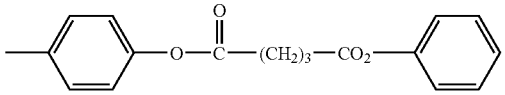 |
| E-49 | 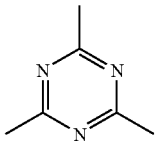 | 3 | —N(H)— | 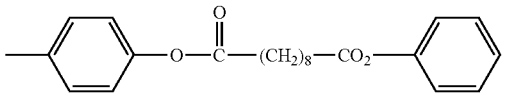 |
| E-50 | 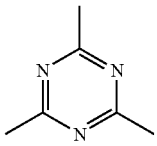 | 3 | —N(H)— | 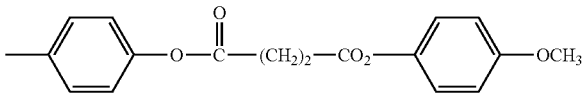 |
| E-51 | 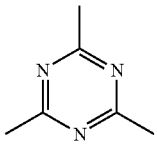 | 3 | —N(H)— | 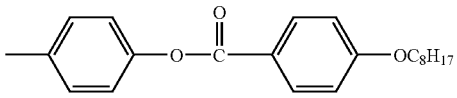 |

-continued
$(R—X)_m—D$
| | D | m | X | R |
|---|---|---|---|---|
| E-52 | 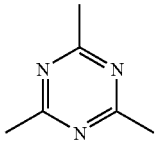 | 3 | —N(H)— | 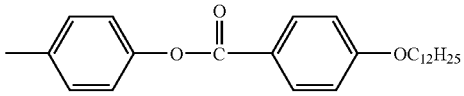 |
| E-53 | 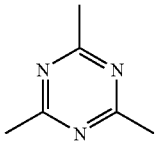 | 3 | —N(H)— | 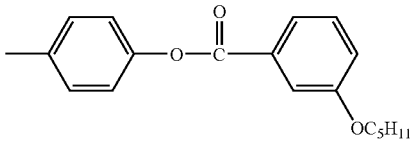 |
| E-54 | 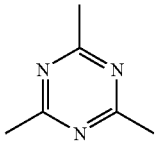 | 3 | —N(H)— | 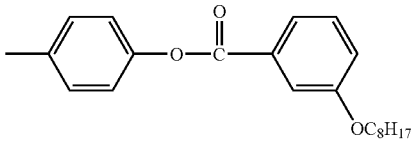 |
| E-55 | 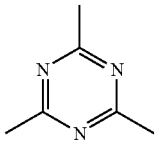 | 3 | —N(H)— | 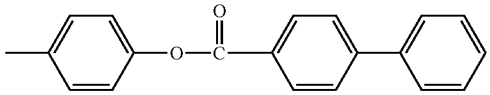 |
| E-56 | 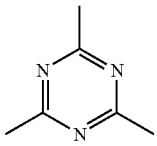 | 3 | —N(H)— | 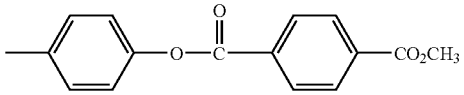 |
| E-57 | 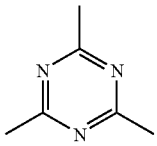 | 3 | —N(H)— | 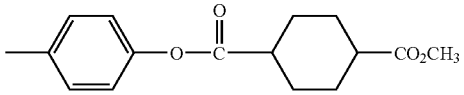 |
| E-58 | 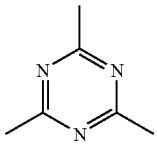 | 3 | —N(H)— | 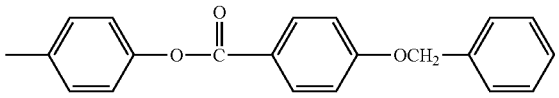 |
| E-59 | 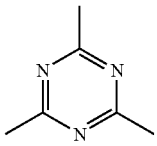 | 3 | —N(H)— | 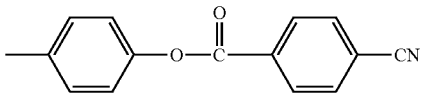 |
| E-60 | 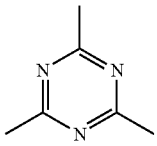 | 3 | —N(H)— | 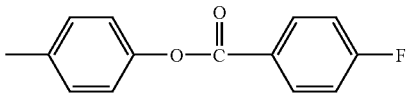 |

The compounds of the present invention may be prepared by various processes. For example, the compounds may be prepared through reactions of discotic compounds with regents capable of introducing side chains containing an ester bond into the discotic cores, such as nucleophilic substitution reactions of cyanuric chloride, alkylations of thiocyanuric acid, coupling reactions of benzene derivatives or alkylations, etherifications or amide-formation reactions of hydroxide benzene derivatives. The compounds may also be prepared by creating cyclic compounds using compounds having ester groups in side chains to form discotic compounds. Among these processes, the processes comprising reactions of cyclic compounds having chlorine such as cyanuric chloride or pyrimidine chloride with compounds having active hydrogen such as amine, alcohol, phenol, thioalcohol or thiophenol, are preferred; and the processes comprising reactions of cyanuric chloride are more preferred.

Examples of the organic solvent, which may be used for the reactions, include halogenated hydrocarbon base organic solvents such as dichloromethane, ester base organic solvents such as methyl acetate or ethyl acetate, ketone base organic solvents such as acetone or methylethylketone, ether base organic solvents such as tetrahydrofuran or dioxane, nitrile base organic solvents such as acetonitrile or propionitrile, amide base organic solvents such as N,N-dimethyl formamide, N,N-dimethylacetamide, 1,3-dimethyl-2-imidazolidone, 1,3-dimethyl-3,4,5,6,-tetrahydro-2(1H)-pyrimidinone (DMPU) or triamide hexamethylphosphate, and sulfoxide base organic solvents such as dimethylsulfoxide. Catalysts or bases may be used if needed.

The compound used for the lubricant composition of the present invention can independently be used as a lubricant, and also used in a mixed form with a lubricant base oil such as mineral oils or synthetic oils. The mineral or synthetic oil is not specifically be limited, and any of those generally used as a lubricant base oil will be available. Possible examples of such lubricant base oil include solvent-refined raffinate obtained by extracting a source oil, which is derived from a paraffin-base, intermediate-base or naphthene-base crude oil by distillation under atmospheric or reduced pressure, using an aromatic solvent such as phenol, furfural or N-methylpyrrolidone; hydrogenated oil obtained by treating the source oil with hydrogen under hydrogenation conditions in the presence of hydrogenation catalyst such as cobalt or molybdenum immobilized on silica-alumina support; isomerized oil obtained by treating the source oil with hydrogen under severe decomposition reaction conditions in the presence of hydrogenation decomposition catalyst; and fraction of lubricating oil obtained by a combined process of solvent refining and hydrogenation of the source oil, or by a combined process of hydrogenation and isomerization or the like. In particular, those obtained by a combined process of hydrogenation and isomerization or the like, having high viscosity index, are preferable. Any of such manufacturing methods can arbitrarily be added with the individual processes for dewaxing, hydrogenation finishing and clay treatment. The mineral oil can also be classified into soft neutral oil, medium neutral oil, heavy neutral oil and bright stock, which can properly be mixed depending on target performances.

The synthetic oil can be exemplified by poly(α-olefin), α-olefin oligomer, polybutene, alkylbenzene, polyol ester, dibasic acid ester, polyoxyalkylene glycol, polyoxyalkylene glycol ether and silicone oil. These mineral oils and synthetic oils may be used independently or in any combinations of two or more thereof. It is also allowable to use mineral oil and synthetic oil in combination. Such lubricant base oil generally has a kinematic viscosity of 2 to 20 $mm^2/s$ at 100° C., and preferably 3 to 15 $mm^2/s$. It is allowable to properly select a mixed base oil having an optimum kinematic viscosity so as to well suit to lubricating conditions for mechanical fiction sliding member to which the lubricant composition of the present invention is applied.

For the case the lubricant composition of the present invention is a mixture of the foregoing compound having an ester bond and a lubricant base oil, preferable amount of the compound is 0.1 to 20 wt % and preferable amount of the mineral oil and or synthetic oil is 80 to 99.9 wt % of the total weight of the lubricant base oil. The amount of the compound having an ester bond is more preferably 0.1 to 10 wt %, and still more preferably 0.1 to 5 wt %.

However, the compound having an ester bond can be used as a basic oil of a lubricant composition alone. Using the compound alone for a lubricant basic oil, it is often possible to obtain more excellent effect, for example it is possible to obtain low friction coefficient over a wider temperature range even under severe lubricant condition and as well as more excellent wear resistance, compared with using the compound in combination with other basic oil.

While the lubricant composition of the present invention contains the foregoing compound having an ester bond as a major component, it is also allowable, as occasion demands, to add any known additives having been used for conventional lubricant such as bearing oil, gear oil and power transmission oil, in order to attain practical performances adopted for the individual applications within a range not adversely affecting the effects of the present invention, where such additives include wear preventive agent, extreme pressure agent, antioxidant, viscosity index raising agent, clean dispersion aid, metal passivation agent, corrosion preventive agent, rust preventive agent, and defoaming agent.

The lubricant composition of the present invention has specific features of low friction coefficient, anti-abrasiveness and extreme pressure properties under severe lubricating conditions. One embodiment, which is optimum and suitable for practical use, of the lubricant composition of the present invention can be prepared by using one or more compounds selected from the formula (1), desirably selected from formula (2) and more desirably selected from the formula (3), so that the composition can exist in liquid form even under temperature as low as −40° C.

Further, the lubricant composition of the present invention can successfully reduce burn-in, improve wear resistance and keep the friction coefficient low even when it is supplied onto the surface moving under a friction condition which is severe enough for the conventional lubricating oil or lubricant such as grease to cause breakage of the oil film. For example, the lubricant composition of the present invention can preferably be used as an energy-saving lubricant for bearings or gears which move under severe friction conditions, and can further contribute to improvement in the reliability and downsizing of sliding members.

EXAMPLES

The present invention will more specifically be explained referring to preferred examples. It is to be noted that materials, reagents, ratio of use thereof, and operation can properly be modified without departing from the spirit of the present invention. Therefore the scope of the present invention is by no means limited to the preferred examples described below.

[Synthetic Example of Compound N-28]

Compound N-28 was synthesized according to the following scheme.

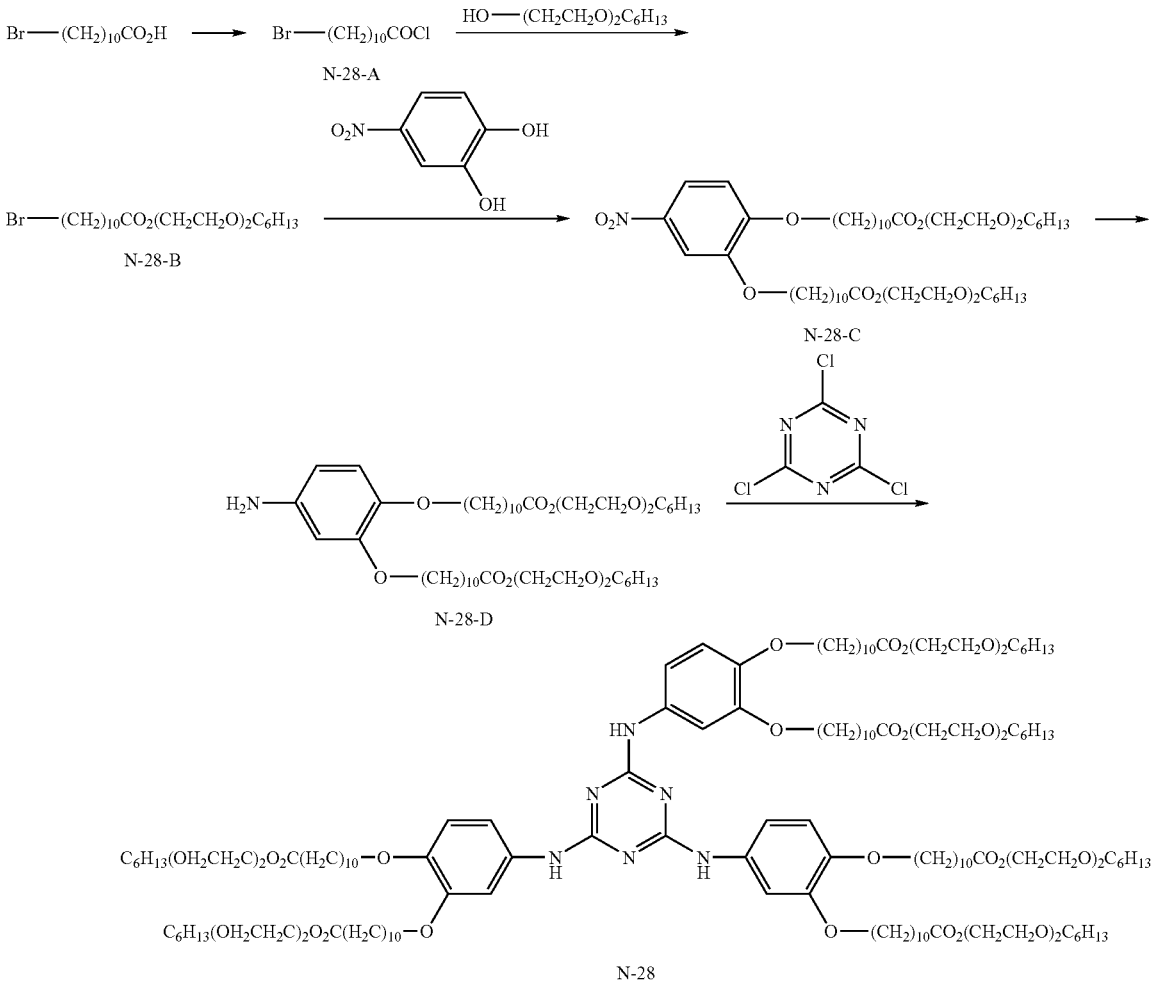

(Synthesis of Compound N-28-A)

A130 ml of toluene, a 345 g (1.3 mol) of 11-Bromoundecanoic acid and a 0.1 ml of N,N-dimethylformamide were put in a 1L-reactor vessel which was equipped with a stirrer and a reflux condenser. A 114 ml (1.58 mol) of thionyl chloride was added dropwise to the solution for 30 minutes. After adding, the solution was stirred at 60° C. for 2 hrs. After the termination of the reaction, the solvent was distilled off under reduced pressure. Thus a 373 g of Compound N-28-A was obtained in a 99% yield.

(Synthesis of Compound N-28-B)

A 1L of acetonitrile, a 272 g (1.3mol) of diethylene glycol monohexylether and a 199 g (1.43 mol) of triethylamine were put in a 3L-reactor vessel which was equipped with a stirrer, a dropping funnel and a thermometer, and the mixture was stirred, to give a solution. The solution was cooled at 16° C., and a 369 g (1.3 mol) of the obtained Compound N-28-A was added dropwise to the solution for one hour. After adding, the solution was stirred for 1.5 hrs. After being extracted with ethyl acetate, the organic layer was washed with water, was separated from the extract, and dried with anhydrous magnesium sulfate. The organic layer was evaporated to dryness under reduced pressure and the solvent was removed. Thus a 590 g of Compound N-28-B was obtained.

(Synthesis of Compound N-28-C)

A 70 g (0.45 mol) of 4-nitrocatechol, a 481 g (1.1 mol) of the obtained Compound N-28-B and a 350 ml of N,N-dimethylformamide were put in a 3L-reactor vessel which was equipped with a stirrer, a reflux condenser and a thermometer, and the mixture was stirred to give a solution. After addition of a 152 g (1.1 mol) of potassium carbonate, the solution was heated up to 98° C., and stirred for 2 hrs. After being cooled down to room temperature, the reaction mixture was extracted with ethyl acetate. After the organic layer was washed with water, the organic layer was dried over anhydrous magnesium sulfate. The organic layer was concentrated under reduced pressure. Thus a 455 g of Compound N-28-C was obtained.

(Synthesis of Compound N-28-D)

A 150 g (2.7 mol) of reduced iron, 600 ml of isopropyl alcohol, a 120 ml of water and a 15 g of ammonium chloride were put in a 3L-reactor vessel which was equipped with a stirrer, reflux condenser and a thermometer, and the mixture was stirred and refluxed at 90° C. under heating. The obtained Compound N-28-C was added dropwise to the mixture, and then the mixture was stirred under heating for 2 hrs. After the termination of the reaction, the mixture was filtered through Celite while being heated. The filtrate was extracted with ethyl acetate, and the organic layer was washed with water.

After drying over anhydrous magnesium sulfate, the organic layer was concentrated under reduced pressure to give a 425 g of a crude product. The product was purified by silica gel column chromatography, to give a 237 g of Compound N-28-D in a 91% yield.

(Synthesis of Compound N-28)

A 500 ml of N,N-dimethylformamide was poured into a 3L-reactor vessel which was equipped with a stirrer, a reflux condenser and a thermometer, and a 220 g (0.26 mol) of the obtained Compound N-28-D was added into the reactor. Subsequently, a 15 g (0.08 mol) of cyanuric chloride was added dropwise to the mixture for 30 minutes. After addition of a 40 g (0.3 mol) of potassium carbonate, the mixture was stirred under heating at 98° C. for 2 hrs. After being cooled down to the room temperature, the mixture was extracted with ethyl acetate. After being washed with water, the organic layer was dried over anhydrous magnesium sulfate. The organic layer was concentrated under reduced pressure to give a 232 g of crude product. The crude product was purified by silica gel column chromatography, and thus a 166 g of Compound N-28 was obtained in an 80% yield.

NMR data of the obtained compound is shown below.

$^1$H NMR (300 MHz $CDCl_3$):δ7.15-6.80(m,9H), 4.25(t,12H), 3.95(t,12H), 3.70(t,12H), 3.65(t,12H), 3.60(m,12H), 3.45(t,12H), 2.30(t,12H), 1.80-1.30(m,144H), 0.85(t,18H).

It is noted that Compound S-28 can be synthesized in the same manner as the above-described synthetic example of Compound N-28, except that catechol is used in the place of 4-nitorocatechol and introduction of mercapto group is carried out, and then reaction with cyanuric chloride is carried out. It is also noted that Compound B-9 can be synthesized in the same manner as the above-described synthetic example of Compound N-28, except that hexahydrotriphenylene is used in the place of 4-nitorocatechol.

Examples No. 1 to 10

Evaluations of Lubricant Compositions

Lubricant compositions of Example Nos. 1 to 10, shown in Table 1 below, were prepared by respectively using Compound N-8, Compound N-28, Compound N-34, Compound S-34, Compound B-5 and Compound B-9, which fall within the scope of the Formula (1), and lubricant base oil. And lubricant compositions of Comparative Example Nos. 1 to 8, shown in Table 2 below, were prepared by using lubricant oil alone or in combinations with Comparative Compounds M1 or M2 shown below. The obtained compositions were subjected to reciprocating type (SRV) friction wear test under conditions listed below in order to evaluate friction coefficient. The results of Example Nos. 1 to 10 are shown in Table 1 and the results of Comparative Example Nos. 1 to 8 were shown in Table 2.

Test Conditions

Tests were subjected under Cylinder on Plate Test.
Specimen (friction material): SUJ-2
Plate : 24 mm in diameter, 6.9 mm thick
Cylinder : 11 mm in diameter, 15 mm long
Temperature : 60° C. or 100° C.
Load : 400 N
Amplitude : 1.5 mm
Frequency : 50 Hz
Testing period : for 5 min. after the start of testing

TABLE 1

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Compound of the present | Exemplified Compound No. | N-8 | N-28 | N-34 | S-34 | N-8 | N-28 | N-34 | S-34 | B-5 | B-9 |
| | wt % | 100 | 100 | 100 | 100 | 5 | 5 | 5 | 5 | 100 | 100 |
| Lubricant base oil wt % | Pentaerythritol ester*1 | — | — | — | — | 95 | — | — | — | — | — |
| | Alkylbenzene*2 | — | — | — | — | — | 95 | — | — | — | — |
| | Naphthene-base mineral oil | — | — | — | — | — | — | 95 | — | — | — |
| | Paraffin-base mineral oil | — | — | — | — | — | — | — | 95 | — | — |
| Friction coefficient | SRV friction wear test at 400 N, 60° C. | 0.04 | 0.03 | 0.03 | 0.03 | 0.07 | 0.07 | 0.07 | 0.08 | 0.04 | 0.04 |
| | SRV friction wear test at 400 N, 100° C. | 0.04 | 0.03 | 0.03 | 0.03 | 0.08 | 0.08 | 0.08 | 0.08 | 0.05 | 0.04 |

*1Hexanoic acid ester of pentaerythritol
*2Alkylbenzene having $C_{10}$ alkyl groups

TABLE 2

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Comparative Compound | No. | — | — | — | — | M-1 | M-2 | M-1 | M-2 |
| | wt % | | | | | 100 | 100 | 5 | 5 |
| Lubricant base oil wt % | Pentaerythritol ester*1 | 100 | — | — | — | — | — | 95 | — |
| | Alkylbenzene*2 | — | 100 | — | — | — | — | — | 95 |
| | Naphthene-base mineral oil | — | — | 100 | — | — | — | — | — |

TABLE 2-continued

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| | Paraffin-base mineral oil | — | — | — | 100 | — | — | — | — |
| Friction coefficient | SRV friction wear test at 400 N, 60° C. | 0.2 | 0.22 | 0.24 | 0.22 | 0.05 | 0.05 | 0.09 | 0.09 |
| | SRV friction wear test at 400 N, 100° C. | 0.21 | 0.23 | 0.24 | 0.22 | 0.06 | 0.06 | — | — |

*1Hexanoic acid ester of pentaerythritol
*2Alkylbenzene having $C_{10}$ alkyl groups

Example Nos. 11 to 16

Evaluations of Lubricant Compositions

Lubricant compositions of Example Nos. 11 to 16, shown in Table 3 below, were prepared by respectively using Compound E-31, Compound E-32, Compound E-36, Compound E-37, Compound E-51 and Compound E-53, which fall within the scope of the Formula (1), and lubricant base oil. And lubricant compositions of Comparative Example Nos. 9 and 10, shown in Table 3 below, were prepared by using lubricant oil alone or in combinations with Comparative Compounds M1 or M2 shown below. The prepared compositions were subjected to reciprocating type (SRV) friction wear test under conditions listed below in order to evaluate friction coefficient. The results of Example Nos. 11 to 16 are shown in Table 3.

Test Conditions

Tests were subjected under Cylinder on Plate Test.
Specimen (friction material): SUJ-2
Plate: 24 mm in diameter, 6.9 mm thick
Cylinder: 11 mm in diameter, 15 mm long
Temperature: 150° C. or 200° C.
Load: 400 N
Amplitude: 1.5 mm
Frequency: 50 Hz
Testing period: for 30 min. after the start of testing Comparative Compound M-1, which is as same as the exemplified compound LUB-20 described in JPA No. 2002-69472, only except having an alkoxy group of the carbon number different from that of LUB-20;

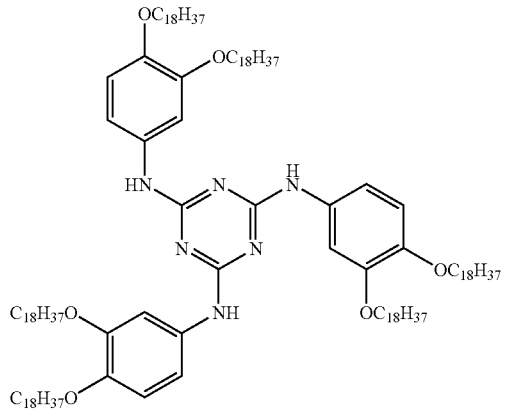

Comparative Compound M-2, which is as same as the exemplified compound LUB-28 described in JPA No. 2002-69472;

TABLE 3

| | | Example 11 | Example 12 | Example 13 | Example 14 | Example 15 | Example 16 | Comparative Example 9 | Comparative Example 10 |
|---|---|---|---|---|---|---|---|---|---|
| Compound | No. | E-31 | E-32 | E-36 | E-37 | E-51 | E-53 | M-1 | M-2 |
| | wt % | 100 | 100 | 100 | 100 | 100 | 100 | 100 | 100 |
| Lubricant base oil wt % | Pentaerythritol ester*1 | — | — | — | — | — | — | — | — |
| | Alkylbenzene*2 | — | — | — | — | — | — | — | — |
| | Naphthene-base mineral oil | — | — | — | — | — | — | — | — |
| | Paraffin-base mineral oil | — | — | — | — | — | — | — | — |
| Friction coefficient | SRV friction wear test at 400 N, 150° C. | 0.05 | 0.05 | 0.04 | 0.04 | — | — | 0.12 | 0.12 |
| | SRV friction wear test at 400 N, 200° C. | 0.04 | 0.04 | 0.04 | 0.04 | 0.03 | 0.03 | 0.15 | 0.15 |

*1Hexanoic acid ester of pentaerythritol
*2Alkylbenzene having $C_{10}$ alkyl groups

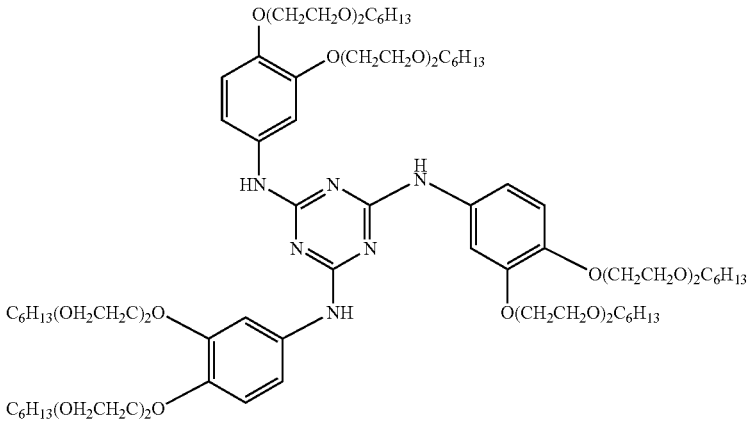

INDUSTRIAL APPLICABILITY

According to the present invention, it is possible to provide a lubricant composition having anti-abrasiveness, extreme pressure property and low friction property enough to be practically used, on the sliding surface. It is also possible to provide a lubricant composition capable of exhibiting excellent properties not only in a state of mixture with conventional lubricant base oil, but also in a state not mixed with such lubricant base oil, and a method for preparing thereof. It is also possible to provide novel and useful compounds, containing ester groups, capable of retaining excellent lubricant properties in a wide temperature range.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A lubricant composition comprising at least one compound selected from the group represented by a formula (3);

Formula (3)

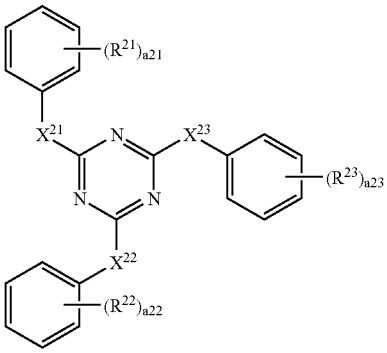

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; $R^{21}$, $R^{22}$ and $R^{23}$ respectively represent a substituent group provided that at least one of $R^{21}$, $R^{22}$ and $R^{23}$ contains an ester bond; and a21, a22 and a23 respectively represent an integer from 1 to 5, wherein at least one of $R^{21}$, $R^{22}$ and $R^{23}$ is selected from the group represented by a formula (4*a*), formula (4*b*), formula (5) or formula (6);

Formula (4a)

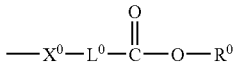

Formula (4b)

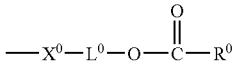

wherein $X^0$ represents a single bond or a bivalent linking group selected from the group consisting of $NR^1$, wherein $R^1$ is a hydrogen atom or $C_{1-30}$ alkyl group, oxygen, sulfur, carbonyl, sulfonyl or any combinations thereof: $L^0$ represents a bivalent linking group selected from the group consisting of an alkylene group, $NR^1$, wherein $R^1$ is a hydrogen atom or $C_{1-30}$ alkyl group, oxygen, sulfur, carbonyl, sulfonyl or any combinations thereof; and $R^0$ represents a substituted or non-substituted alkyl group or aryl group;

Formula (5)

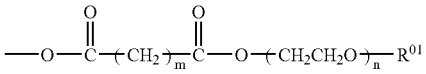

where $R^{01}$ is a substituted or non-substituted $C_{1-30}$ alkyl group and m and n respectively represent an integer;

Formula (6)

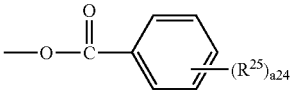

where $R^{25}$ is a substituent group and a24 is an integer from 1 to 5.

2. A triazine-ring-containing compound represented by a formula (3);

Formula (3)

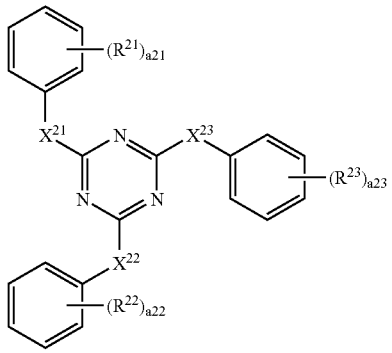

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; and $R^{21}$, $R^{22}$ and $R^{23}$ respectively represent a substituted group provided that at least one of $R^{21}$, $R^{22}$ and $R^{23}$ contains an ester bond; and a21, a22 and a23 respectively represent an integer from 1 to 5, wherein at least one of $R^2$, $R^{22}$ and $R^{23}$ is selected from the group represented by a formula (4);

Formula (4)

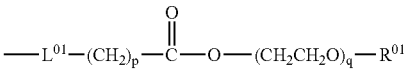

where $L^{01}$ is a bivalent linking group selected from the group consisting of a alkylene group, $NR^1$, where $R^1$ is a hydrogen atom or a $C_{1-30}$ alkyl group, oxygen, sulfur, carbonyl, sulfonyl and any combinations thereof and the bivalent linking group may be substituted or non-substituted; $R^{01}$ is a substituted or non-substituted $C_{1-30}$ alkyl group; and p and q respectively represent an integer.

3. A triazine-ring-containing compound represented by formula (3);

Formula (3)

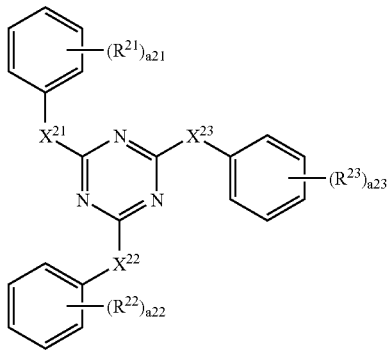

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; $R^{21}$, $R^{22}$ and $R^{23}$ respectively represent a substituted group provided that at least one of $R^{21}$, $R^{22}$ and $R^{23}$ contains an ester bond; and a21, a22 and a23 respectively represent an integer from 1 to 5, wherein at least one of $R^{21}$, $R^{22}$ and $R^{23}$ is selected from the group represented by a formula (5);

Formula (5)

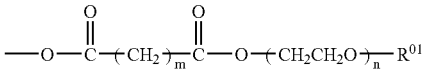

where $R^{01}$ is a substituted or non-substituted $C_{1-30}$ alkyl group, and m and n respectively represent an integer.

4. A triazine-ring-containing compound represented by formula (3);

Formula (3)

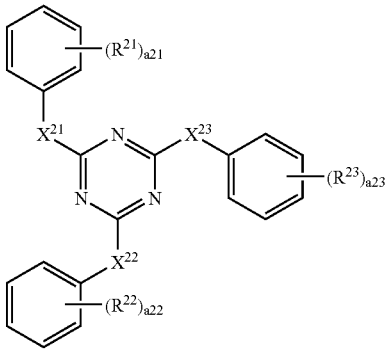

where $X^{21}$, $X^{22}$ and $X^{23}$ respectively represent a single bond or a bivalent linking group selected from the group consisting of $NR^1$, where $R^1$ is a hydrogen atom or a $C_{1-30}$ alkyl group, oxygen, sulfur, carbonyl, sulfonyl and any combinations thereof; $R^{21}$, $R^{22}$ and $R^{23}$ respectively represent a substituted group provided that at least one of $R^{21}$, $R^{22}$ and $R^{23}$ contains an ester bond; and a21, a22 and a23 respectively represent an integer from 1 to 5, wherein at least one of $R^{21}$, $R^{22}$ and $R^{23}$ is selected from the group represented by a formula (6);

Formula (6)

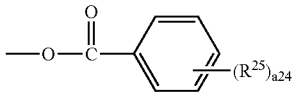

where $R^{25}$ is a substituent group and a24 is an integer from 1 to 5.

5. The lubricant composition of claim 1, wherein at least one of $R^{21}$, $R^{22}$ and $P^{23}$ is selected from the group represented by formula (4), formula (5) or formula (6);

Formula (4)

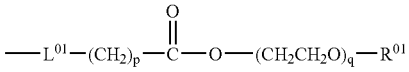

where $L^{01}$ is a bivalent linking group selected from the group consisting of a alkylene group, $NR^1$, where $R^1$ is a hydrogen atom or a $C_{1-30}$ alkyl group, oxygen, sulfur, carbonyl, sulfonyl and any combinations thereof and the bivalent linking group may be substituted or non-substituted; $R^{01}$ is a substituted or non-substituted $C_{1-3}$ alkyl group; and p and q respectively represent an integer;

Formula (5)

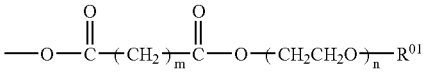

where $R^{01}$ is a substituted or non-substituted $C_{1-30}$ alkyl group, and m and n respectively represent an integer;

Formula (6)

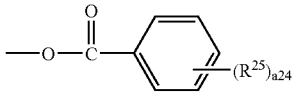

where $R^{25}$ is a substituent group and a24 is an integer from 1 to 5.

* * * * *